US010352100B2

(12) United States Patent
Nguyen

(10) Patent No.: US 10,352,100 B2
(45) Date of Patent: Jul. 16, 2019

(54) DOWNHOLE VIBRATION FOR IMPROVED SUBTERRANEAN DRILLING

(71) Applicant: Halliburton Energy Services, Inc., Houston, TX (US)

(72) Inventor: Minh Dang Nguyen, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 187 days.

(21) Appl. No.: 15/504,310

(22) PCT Filed: Sep. 15, 2014

(86) PCT No.: PCT/US2014/055671

§ 371 (c)(1),
(2) Date: Feb. 15, 2017

(87) PCT Pub. No.: WO2016/043709

PCT Pub. Date: Mar. 24, 2016

(65) Prior Publication Data

US 2017/0226806 A1 Aug. 10, 2017

(51) Int. Cl.

| | |
|---|---|
| ***E21B 4/06*** | (2006.01) |
| ***E21B 7/24*** | (2006.01) |
| ***E21B 4/12*** | (2006.01) |
| ***E21B 47/00*** | (2012.01) |
| *E21B 4/02* | (2006.01) |

(52) U.S. Cl.
CPC ..... *E21B 7/24* (2013.01); *E21B 4/06* (2013.01); *E21B 4/12* (2013.01); *E21B 47/00* (2013.01); *E21B 4/02* (2013.01)

(58) Field of Classification Search
CPC ..... E21B 4/14; E21B 4/10; E21B 7/24; E21B 1/00; E21B 4/06; B25D 11/102
See application file for complete search history.

(56) References Cited

U.S. PATENT DOCUMENTS 2,146,454 A * 2/1939 Sutliff ..... E21B 4/10 175/298
3,396,807 A * 8/1968 Menton ..... E21B 4/10 175/293
3,532,174 A * 10/1970 Hinks ..... B06B 1/183 175/56

(Continued)

FOREIGN PATENT DOCUMENTS

CN 101552575 A 10/2009
CN 103109033 A 5/2013

OTHER PUBLICATIONS

Korean Intellectual Patent Office, International Search Report and Written Opinion, dated Jun. 8, 2015, 21 pages, Korea.

(Continued)

*Primary Examiner* — Kipp C Wallace

(57) ABSTRACT

A downhole oscillation tool and method for axially vibrating a drill bit. In some embodiments, modular actuation assemblies may be provided, which may be readily interchanged between a housing and a shaft to axially vibrate the shaft with respect to the housing. Modular actuation assemblies may be mechanical, hydraulic, electric, or piezoelectric, for example, and may be characterized by differing oscillation frequencies. In some embodiments, a piezo element may be provided between the housing and the shaft.

30 Claims, 17 Drawing Sheets

(56) References Cited

U.S. PATENT DOCUMENTS 3,610,347 A * 10/1971 Diamantides ..... E21B 7/24 175/56
3,842,920 A * 10/1974 Barnetche-Gonzalez ..... E21B 4/06 173/202
4,830,122 A 5/1989 Walter
5,601,152 A 2/1997 Harrison
5,662,180 A * 9/1997 Coffman ..... E21B 4/00 173/112
6,047,778 A 4/2000 Coffman et al.
6,050,349 A 4/2000 Rountree et al.
6,152,222 A * 11/2000 Kyllingstad ..... E21B 4/14 166/177.6
6,367,565 B1 * 4/2002 Hall ..... E21B 4/14 175/296
7,740,088 B1 * 6/2010 Bar-Cohen ..... E21B 7/24 175/415
7,762,354 B2 7/2010 Garcia-Osuna
7,882,906 B1 2/2011 DeCuir, Sr.
8,162,078 B2 4/2012 Anderson
8,225,883 B2 7/2012 Hall et al.
8,297,375 B2 10/2012 Hall et al.
8,322,463 B2 12/2012 Walter
8,678,107 B2 3/2014 Benson
8,720,608 B2 * 5/2014 Downton ..... E21B 4/06 175/293
9,322,237 B2 * 4/2016 Schicker ..... E21B 4/10
2001/0054515 A1 12/2001 Eddison et al.
2002/0063496 A1 * 5/2002 Forck ..... H01L 41/277 310/332
2003/0230430 A1 * 12/2003 Martini ..... E21B 4/10 175/57
2004/0089461 A1 * 5/2004 Cioceanu ..... E21B 4/10 173/90
2010/0065330 A1 3/2010 Walter
2011/0198126 A1 8/2011 Swietlik et al.
2012/0107062 A1 5/2012 Moraru et al.
2012/0247757 A1 * 10/2012 Swinford ..... E21B 4/14 166/249
2014/0110178 A1 4/2014 Savage et al.
2014/0174726 A1 * 6/2014 Harrigan ..... E21B 31/005 166/250.01
2016/0040528 A1 * 2/2016 Benson ..... E21B 34/00 175/40

OTHER PUBLICATIONS

Demeng Che, Peidong Han, Ping Guo and Kornel Ehmann, Issues in Polycrystalline Diamond Compact Cutter—Rock Interaction From a Metal Machining Point of View—Part I: Temperature, Stresses, and Forces, Dec. 2012, 10 Pages, vol. 134, Journal of Manufacturing Science and Engineering.

Y.S.Liao, Y.C.Chen and H.M.Lin, Feasibility study of the ultrasonic vibration assisted drilling of Inconel superalloy, Feb. 24, 2007, 9 pages, International Journal of Machine Tools & Manufacture 47 (2007) 1988-1996, Science Direct.

D.E. Brehl, and T.A.Dow, Review of vibration-assisted machining, Aug. 22, 2007, 20 pages, Precision Engineering 32 (2008) 153-172, Science Direct.

L.Gerbaud, S.Menand, and H.Sellami, PDC Bits: All Comes From the Cutter/Rock Interaction, Feb. 21-23, 2006, 9 pages, IADC/SPE Drilling Conference, SPE 98988, Miami, FL.

Heng Li, Stephen Butt, Katna Munaswamy, Farid Arvani, Experimental Investigation of Bit Vibration on Rotary Drilling Penetration Rate, Jun. 27-30, 2010, 6 pages, ARMA 10-426, 44th US Rock Mechanics Symposium and 5th U.S.-Canada Rock Mechanics Symposium, Salt Lake City, UT.

The Chinese State Intellectual Property Office, First Office Action, dated Mar. 26, 2018, 7 pages, China.

The Chinese State Intellectual Property Office, Search Report, dated Mar. 26, 2018, 3 pages, China.

* cited by examiner

DOWNHOLE VIBRATION FOR IMPROVED SUBTERRANEAN DRILLING

CROSS-REFERENCE TO RELATED APPLICATIONS

This application is a U.S. national stage patent application of International Patent Application No. PCT/US2014/055671, filed on Sep. 15, 2014, the benefit of which is claimed and the disclosure of which is incorporated herein by reference in its entirety.

TECHNICAL FIELD

The present disclosure relates generally to oilfield equipment, and in particular to downhole tools, drilling systems, and drilling techniques for drilling wellbores in the earth.

More particularly still, the present disclosure relates to a method and system for improving the rate of penetration of a drill bit.

BACKGROUND

Drilling systems may use a downhole motor powered by drilling fluid pumped from the surface to rotate a drill bit. Most commonly, a positive displacement motor of the Moineau type, which utilizes uses a spiraling rotor that is driven by fluid pressure passing between the rotor and stator, is employed. Other motor types, however, including turbine motors, may be used as appropriate. The downhole motor and bit may be part of a bottom hole assembly supported from a drill string that extends to the well surface.

The cost to drill a well may be significantly affected by the effective rate of penetration ("ROP") while drilling. As well depth increases, formation rock strength may increase, and the increasing rock strength may result in decreased rate of penetration. It may be desirable, therefore, to increase rock cutting efficiency and/or to reduce the required rock cutting force. Reduced cutting force may result in lower drill bit wear and breakage, less frequently encountered stick-slip conditions, lower probability of shearing the drilling string, and a concomitant greater effective rate of penetration.

BRIEF DESCRIPTION OF THE DRAWINGS

Embodiments are described in detail hereinafter with reference to the accompanying figures, in which.

DETAILED DESCRIPTION

Figure 1:
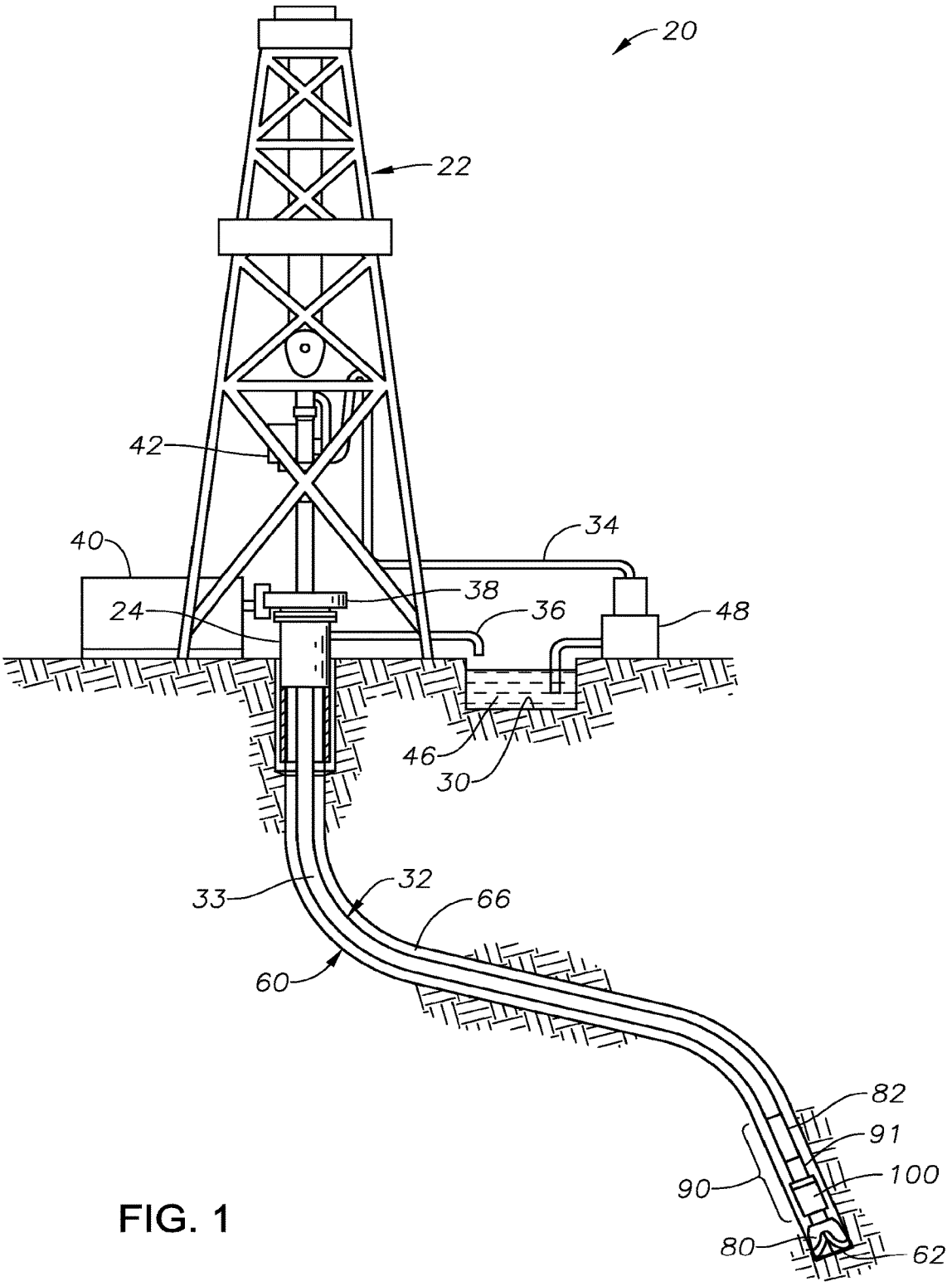
FIG. 1 is an elevation view in partial cross section of a drilling system according to an embodiment that employs a drill string with a bottom hole assembly, a drill bit, and downhole oscillation tool for axially vibrating the drill bit.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 is an elevation view in partial cross-section of a drilling system 20 including a bottom hole assembly 90 according to an embodiment. Drilling system 20 may include a drilling rig 22, such as the land drilling rig shown in FIG. 1. However, teachings of the present disclosure may be used in association with drilling rigs 22 deployed on offshore platforms, semi-submersibles, drill ships, or any other drilling system for forming a wellbore.

Drilling rig 22 may be located proximate to or spaced apart from well head 24. Drilling rig 22 may include rotary table 38, rotary drive motor 40 and other equipment associated with rotation of drill string 32 within wellbore 60. Annulus 66 is formed between the exterior of drill string 32 and the inside diameter of wellbore 60. For some applications drilling rig 22 may also include top drive motor or top drive unit 42. Blowout preventers (not expressly shown) and other equipment associated with drilling a wellbore may also be provided at well head 24.

The lower end of drill string 32 may include bottom hole assembly 90, which may carry at a distal end a rotary drill bit 80. Drilling fluid 46 may be pumped from a reservoir 30 by one or more drilling fluid pumps 48, through a conduit 34, to the upper end of drill string 32 extending out of well head 24. The drilling fluid 46 may then flow through the longitudinal interior 33 of drill string 32, through bottom hole assembly 90, and exit from nozzles formed in rotary drill bit 80. At bottom end 62 of wellbore 60, drilling fluid 46 may mix with formation cuttings and other downhole fluids and debris. The drilling fluid mixture may then flow upwardly through annulus 66 to return formation cuttings and other downhole debris to the surface. Conduit 36 may return the fluid to reservoir 30, but various types of screens, filters and/or centrifuges (not expressly shown) may be provided to remove formation cuttings and other downhole debris prior to returning drilling fluid to reservoir 30. Various types of pipes, tube and/or hoses may be used to form conduits 34 and 36.

According to an embodiment, bottom hole assembly 90 may include a downhole mud motor 82. Bottom hole assembly 90 may also include various other tools 91, such as those that provide logging or measurement data and other information from the bottom of wellbore 60. Measurement data and other information may be communicated from end 62 of wellbore 60 using measurement while drilling techniques and converted to electrical signals at the well surface to, among other things, monitor the performance of drilling string 32, bottom hole assembly 90, and associated rotary drill bit 80. However, sometimes conversion and/or processing of measurement data and other information may occur downhole.

According to one or more embodiments, drilling system 20 may include a downhole oscillation tool 100. Downhole oscillation tool 100 may operate to apply an axial oscillation to rotary drill bit 80 as bit 100 rotates, as described hereinafter. Downhole oscillation tool 100 may be located within bottom hole assembly 90.

Figure 2:
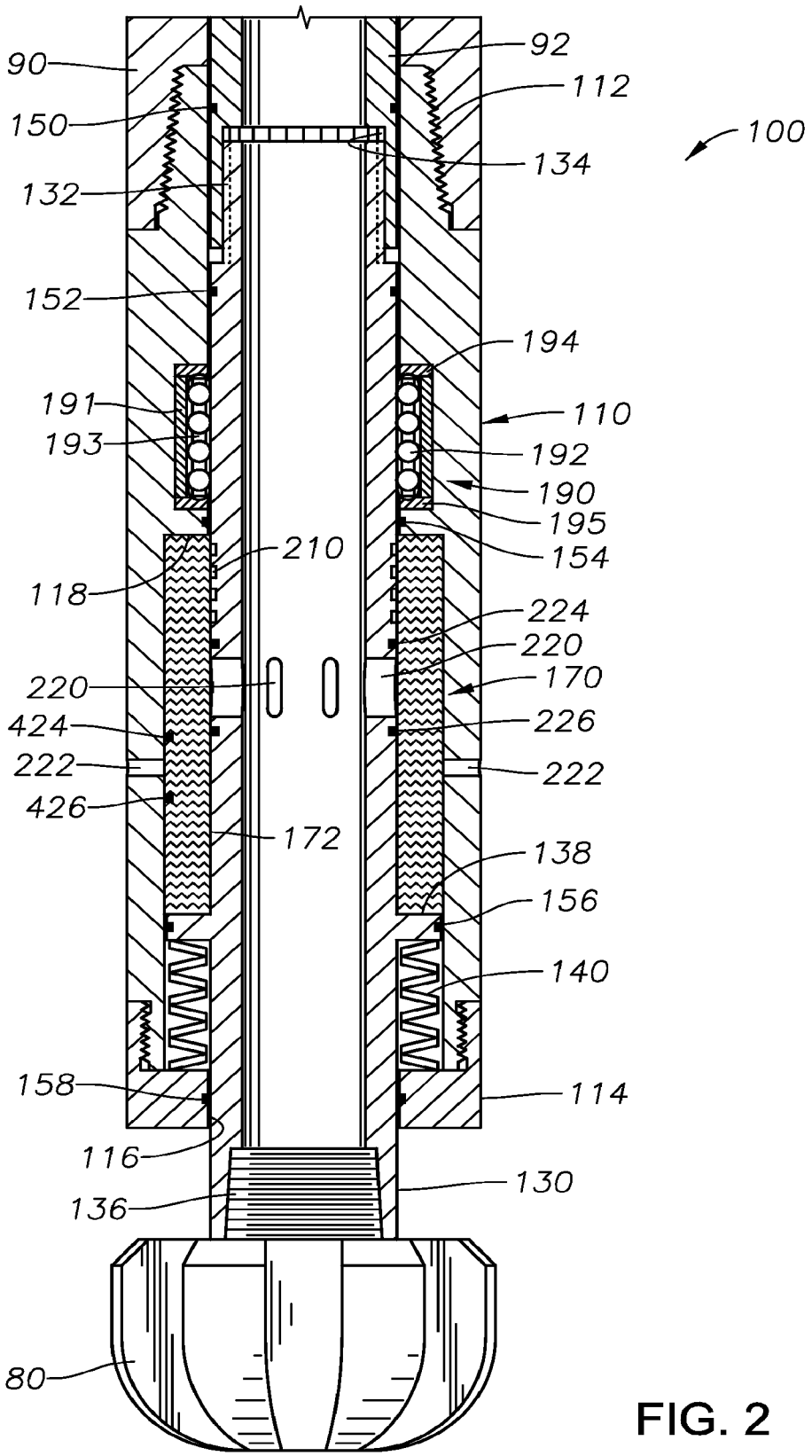
FIG. 2 is an axial cross section of a downhole oscillation tool according to an embodiment, showing a housing, a shaft rotatable and axially translatable within the housing and carrying a drill bit, and a generalized interchangeable modular actuator assembly for axially vibrating the shaft with respect to the housing.
Figure 3:
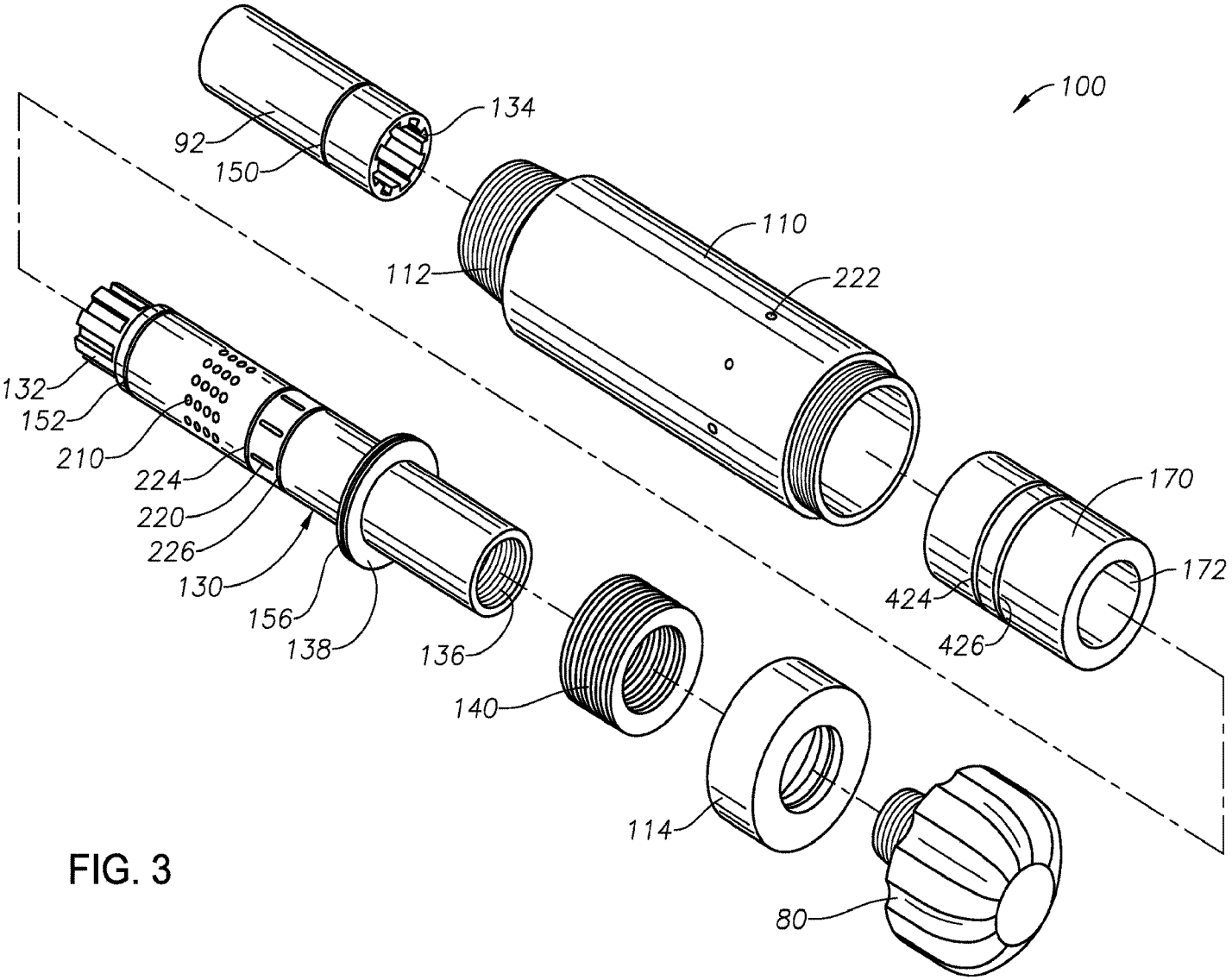
FIG. 3 is an exploded perspective view of the downhole oscillation tool of FIG. 2.

FIG. 2 is an axial cross section and FIG. 3 is an exploded perspective view of downhole oscillation tool 100 according to an embodiment. Referring to FIGS. 2 and 3, downhole oscillation tool 100 may include a housing 110, which may be part of a drill string member, such as a drill collar, a heavy-walled drill pipe, or bottom hole assembly 90, for example. Accordingly, housing 110 may include an upper connector 112 for mechanical connection thereto or may be integrally formed as part thereof Upper connector 112 may be a threaded connector, for example.

A shaft 130 may be rotatively disposed within said housing 110. In an embodiment, shaft 130 may be arranged for mechanical connection with downhole mud motor 82 (FIG. 1), for example, which may be part of bottom hole assembly 90. Accordingly, an upper end of shaft 130 may include a spline fitting 132 for sliding connection to a complementary spline fitting 134 at a lower end of a drive shaft 92 of a mud motor. As illustrated, spline fitting 132 may be an exterior spline fitting for sliding-fit insertion into interior spline fitting 134. However, the opposite configuration may also be used. Spline fitting 132 may provide for torque transmission with limited allowed axial movement between drive shaft 92 of mud motor 83 and shaft 130. Although spline fitting 132 is illustrated, a keyed joint, slot and pin joint, serrations, a slip connection having one or more flats, and/or other alternatives may be used in place of spline fitting 132 as desired.

Drive shaft 92 and shaft 130 may be hollow and fluidly coupled to the interior 33 of drill string 32 (FIG. 1) for the provision of drilling fluid. The lower end of shaft 130 may include a connector 136 for connection to drill bit 80. An upper rotary spine seal 150 may be provided between drive shaft 92 and housing 110 above spline fitting 134 for preventing leakage of drilling fluid past spline fitting 134. Upper spline seal 150 may be carried by drive shaft 92. Likewise, a lower rotary spline seal 152 may be provided between shaft 130 and housing 110 below spline fitting 132. Lower spline seal 152 is arranged to dynamically seal while allowing both rotary and limited axial movement of shaft 130 within housing 110. Lower spline seal 152 may be carried by shaft 130. Upper and lower spline seals 150, 152 may be metallic, ceramic, elastomeric, or polymeric, for example.

In an embodiment, housing 110 may include an internal shoulder 118 located about an interior circumference of housing 110. Shoulder 118 may be integrally formed with housing 110, or it may formed as one or more discrete segments and mounted to housing 110. A rotary shoulder seal 154, which allows both rotation and limited axial movement, may be provided between shaft 130 and the interior wall of shoulder 118. Shoulder seal 154 may be carried by shoulder 118. Shoulder seal 154 may be metallic, ceramic, elastomeric, or polymeric, for example.

Similarly, shaft 130 may include an external flange 138 located about an exterior circumference of shaft 130. Flange 138 may be integrally formed with shaft 130, or it may formed as one or more discrete segments and mounted to housing 130. A rotary flange seal 156, which allows both rotation and limited axial movement, may be provided between the exterior wall of flange 138 and the interior wall of housing 110. Flange seal 156 may be carried by flange 138. Flange seal 156 may be metallic, ceramic, elastomeric, or polymeric, for example.

As described in greater detail hereinafter, downhole oscillation tool 100 may include an interchangeable modular actuator assembly 170, which may be arranged to axially displace shaft 130 with respect to housing 110 in a vibratory or oscillatory manner as shaft 130 rotates with respect to housing 110. Modular actuator assembly 170 may include an axial bore 172 formed therethrough, through which shaft 130 may pass. In an embodiment, modular actuator assembly 170 may be located within housing 110, may be seated against shoulder 118, and may operate on flange 138. Modular actuator assembly 170 may be mechanical, hydraulic, electric, or electronic in nature, may be characterized by relatively low, medium, or high frequency vibration, and may be arranged to be quickly and easily interchanged at the job site to accommodate various formation types and drilling needs.

Shaft 130 may be rotatively and translatably supported within housing 110 by a linear motion bearing assembly 190.

In an embodiment, bearing assembly 190 may be a sealed ball bearing assembly that includes an outer cylindrical cage 191 defining a number of elongated oval recirculating tracks about the circumference, a plurality of balls 192 located within the tracks, an inner cylindrical ball retainer 193, and end rings 194, 195. Balls 192 may engage and roll against the outer surface of shaft 130. Alternatively, a plain linear motion bushing, or another suitable bearing configuration, may be used as linear motion bearing assembly 190.

In an embodiment, downhole oscillation tool 100 may include a spring 140 that urges flange 138 against modular actuator assembly 170. In such an embodiment, modular actuator assembly 170 may function to axially displace flange 138 in opposition to spring 140. Spring 140 may be a helical spring, wave spring, or Belleville spring, for example. In an alternative embodiment, spring 140 may be replaced with a second modular actuator assembly (not illustrated) that operates 180 degrees out of phase with modular actuator assembly 170.

Spring 140 may be held in place within housing 110 by a housing end cap 114. Housing end cap 114 may include a central aperture 116 formed therethrough to accommodate shaft 130. An end cap seal 158, which allows both rotation and limited axial movement, may be provided between shaft 130 and the interior wall of aperture 116. End cap seal 158 may be carried by end cap 114. End cap seal 158 may be metallic, ceramic, elastomeric, or polymeric, for example. End cap 114 may be threadably connected to housing 110.

Shaft 130 may include one or more elongated fluid ports 220 formed through its wall that provide an opening between the interior and exterior of shaft 130. Any suitable number of ports 220 may be provided as desired. In some embodiments, ports 220 may function to provide a source of pressurized drilling fluid flow from the interior 33 of drill string 32 (FIG. 1) for hydraulically powering modular actuator assembly 170 (FIGS. 10-12), as described in greater detail hereinafter. Upper and lower inner actuator seals 224, 226 may be provided above and below ports 220 between shaft 130 and axial bore 172 of modular actuator 170. Inner actuator seals 224, 226 may be arranged to seal against the interior wall of bore 172 while allowing both rotary and limited axial movement of shaft 130 within bore 172. Inner actuator seals 224, 226 may be carried by shaft 130 and may be metallic, ceramic, elastomeric, or polymeric, for example.

Housing 110 may likewise include one or more fluid ports 222 formed through its wall that provide an opening between the interior and exterior of housing 110. Any suitable number of ports 222 may be provided as desired. In some embodiments, ports 222 may function to provide communication of pressurized drilling fluid from modular actuator assembly 170 (FIGS. 10-12) to lower pressure annulus 66 of wellbore 60 (FIG. 1), as described in greater detail hereinafter. Upper and lower outer actuator seals 424, 426 may be provided about the exterior cylindrical wall of modular actuator 170 so as to be positioned above and ports 222. Outer actuator seals 424, 426 may be arranged to seal against the interior wall of housing 110. Outer actuator seals 424, 426 may metallic, ceramic, elastomeric, or polymeric, for example.

In some embodiments, shaft 130 may include a plurality of recesses or grooves formed therein about the circumference and along an axial length of the shaft. Within each recess, a permanent magnet 210 may be affixed for generation of electrical power, as described in greater detail hereinafter.

Figure 4:
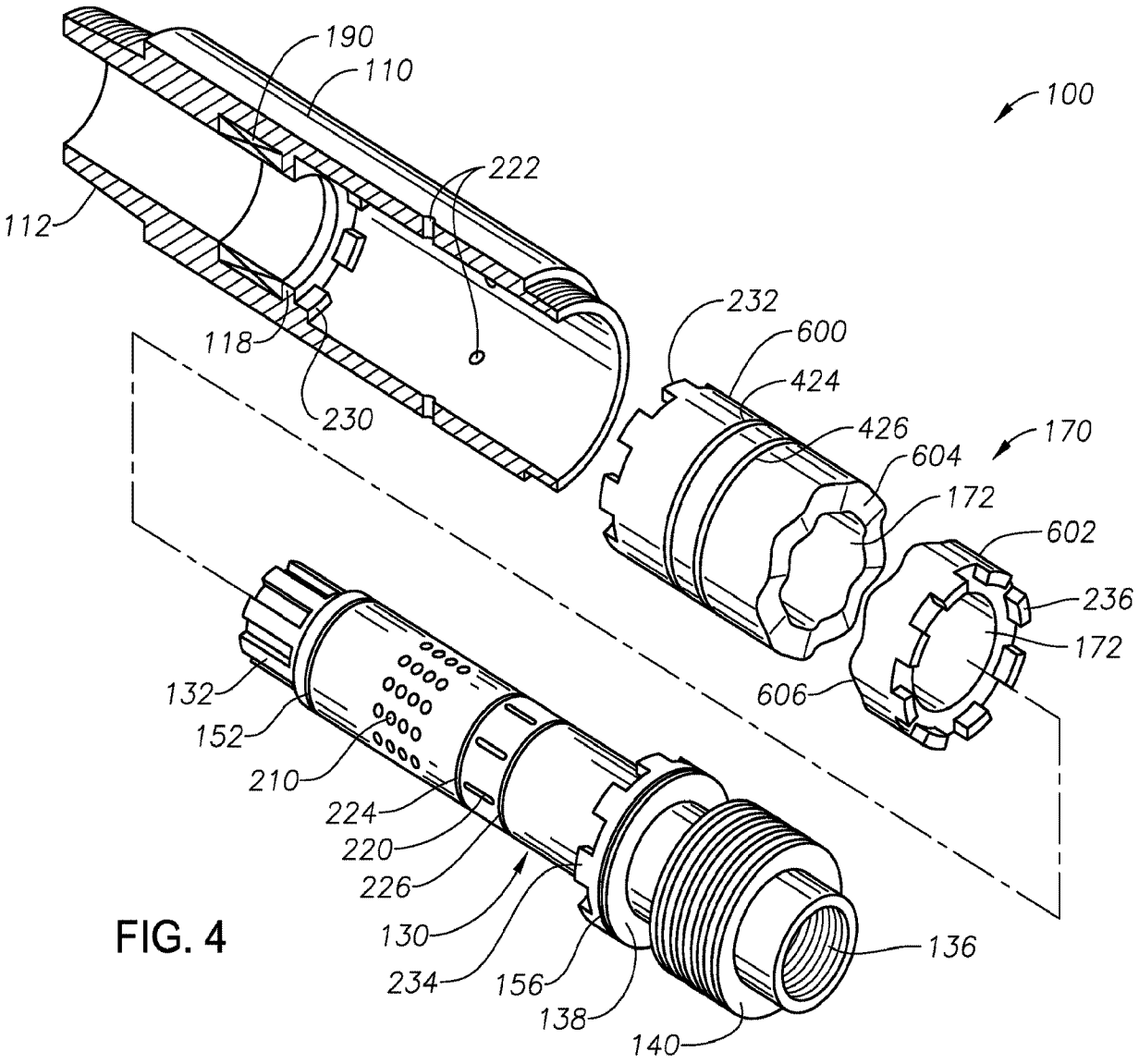
FIG. 4 is an exploded perspective view in partial cross section of a downhole oscillation tool having birth couplings according to an embodiment, shown equipped with a mechanical modular actuator.

FIG. 4 is an exploded perspective view in partial cross section of a downhole oscillation tool having hirth couplings according to one or more embodiments. Referring to FIG. 4, shoulder 118 of housing 110 may include a face having radial teeth 230, which may mesh and rotationally lock with complementary teeth 232 formed on a shoulder-engaging face of modular actuator assembly 170. Such a joint is known to routineers in the mechanical arts as a hirth coupling and is capable of transferring high rotational loads. Although castellated radial teeth are illustrated, saw tooth or curved radial teeth may also be used as desired. Alternatively, longitudinal pins and sockets or other suitable arrangement (not illustrated) may be used to rotatively fix modular actuator 170 within housing 110.

Similarly, according to one or more embodiments, flange 138 of shaft 130 may include a face having radial hirth teeth 234, which may mesh and rotationally lock with complementary hirth teeth 236 located on an obverse, flange-engaging face of modular actuator assembly 170. Although castellated radial teeth are illustrated, saw tooth or curved radial teeth may also be used as desired. Alternatively, longitudinal pins and sockets or other suitable arrangement (not illustrated) may be used to rotatively fix modular actuator 170 to shaft 130.

Figure 5:
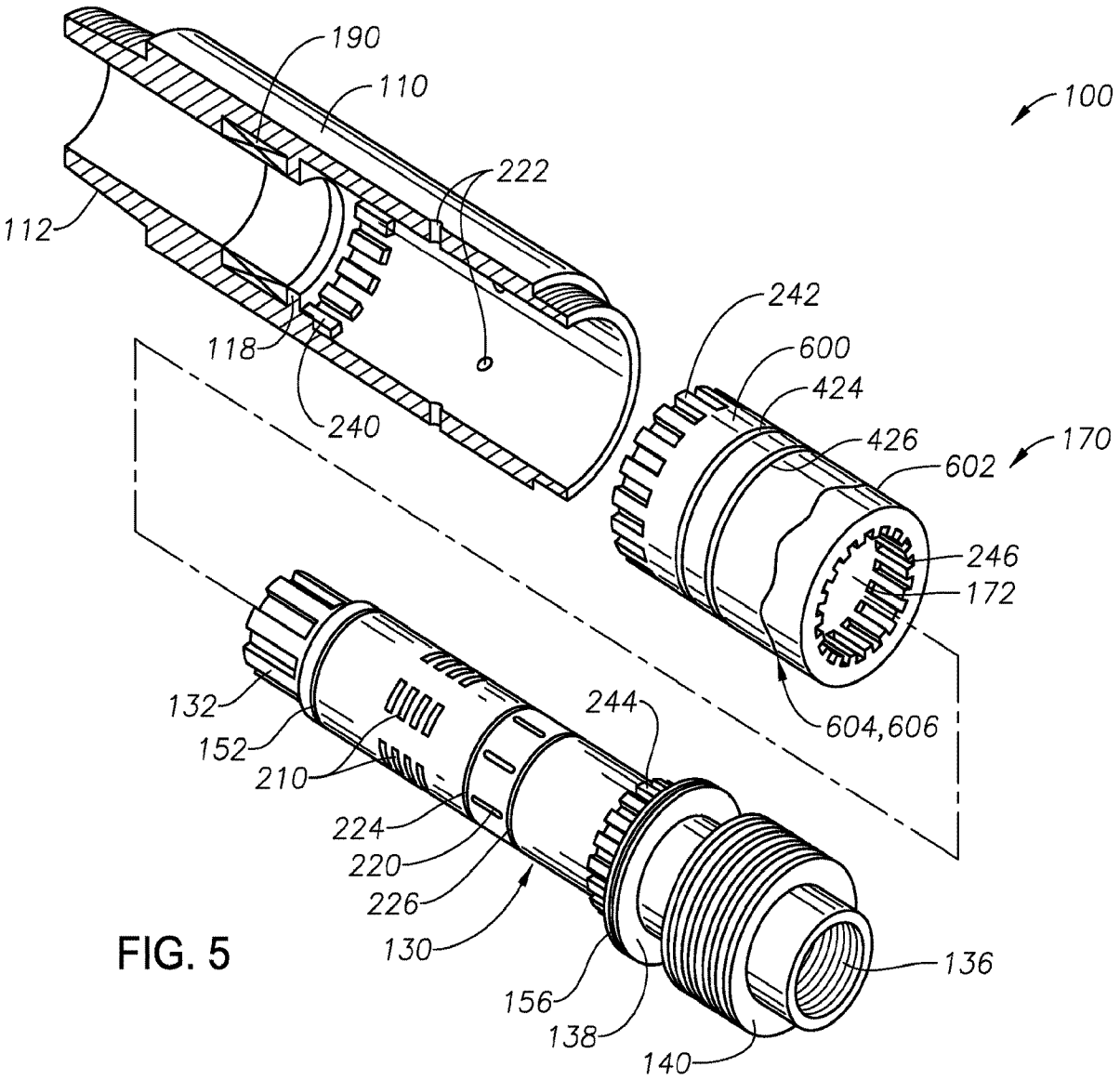
FIG. 5 is an exploded perspective view in partial cross section of a downhole oscillation tool having spline joints according to an embodiment, shown equipped with the mechanical modular actuator of FIG. 4.

FIG. 5 is an exploded perspective view in partial cross section of a downhole oscillation tool having spline joints according to one or more embodiments. Referring to FIG. 5, housing 110 may include an internal spline fitting 240 therein, which may mesh and rotationally lock with a complementary external spline fitting 242 formed about the circumference of modular actuator assembly 170. Spline fittings 240, 242 may be dimensioned for a slip fit. Alternatively, serrations, keyed joints, one or more flats, or other suitable arrangement (not illustrated) may be used to rotatively fix modular actuator 170 within housing 110.

Similarly, according to one or more embodiments, shaft 130 may include an external spline fitting 244, which may mesh and rotationally lock with a complementary internal spline fitting 246 located within axial bore 172 of modular actuator assembly 170. Spline fittings 244, 246 may be dimensioned for a slip fit. Alternatively, serrations, keyed joints, one or more flats, or other suitable arrangement (not illustrated) may be used to rotatively fix modular actuator 170 to shaft 130.

According to some embodiments, modular actuator assembly 170 may be selected from a number of varying interchangeable actuator assemblies, depending on the formation, drill bit, and needs of the operator. For example, FIGS. 4 and 5 disclose a mechanical actuator assembly 170 according to an embodiment. Mechanical actuator assembly 170 may include first and second sleeves 600, 602. First sleeve 600 may be arranged so as to be rotationally fixed with respect to housing 110 via hirth teeth 230, 232 (FIG. 4), splines 240, 242 (FIG. 5), or other suitable arrangement. Similarly, second sleeve 602 may be arranged so as to be rotationally fixed with respect to shaft 130 via hirth teeth 234, 236 (FIG. 4), spline fittings 244, 246 (FIG. 5), or other suitable arrangement.

When downhole oscillation tool 100 is assembled, first sleeve 600 may be seated against shoulder 118 of housing 110, and second sleeve 602 may be seated against flange 138 of shaft 130. First and second sleeves 600, 602 may each have a shaped end 604, 606, respectively, with at least one peaked portion or at least one valley portion, and preferably a plurality of longitudinal peaks intervaled by a plurality of longitudinal valleys. In one or more embodiments, the shaped ends may form corresponding undulating or wavy profiles, while in other embodiments, the shaped ends may form corresponding saw tooth profiles. However, the disclosure is not limited to a particular profile so long as the vibrational or oscillating motion described herein is achieved. Spring 140 may urge flange 138 against mechanical actuator assembly 170 so that the two shaped ends 604 engage one another. Rotation of shaft 130 with respect to housing 110 may then cause shaped end 606 of second sleeve 602 to rotate against shaped end 604 of first sleeve 600, thereby alternately shifting between a peak-to-valley alignment (FIG. 5) and a peak-to-peak alignment. The peak-to-peak alignment may axially displace shaft 130 via flange 138 to further compress spring 140. In this manner, shaft 130 and drill bit 80 (FIGS. 1-3) may be axially oscillated as shaft 130 is rotated with respect to housing 110. It will be noted that while uniform oscillations or a uniform vibrational frequency may be achieved with uniform contours along the full perimeter of the ends 604, 606, in other embodiments, the ends 604, 606 may be shaped so as to yield non-uniform oscillations, i.e., a non-uniform vibrational frequency. In this regard, any of the modular actuators described herein may be manipulated accordingly to provide uniform or non-uniform oscillations, as desired.

Mechanical actuator assembly 170 may be characterized by a generally low oscillation frequency. The longitudinal amplitude between peaks and valleys and the circumferential peak-to-peak wavelength spacing of shaped ends 604, 606 may be varied to provide a desired oscillation displacement and frequency. Additionally, shaped ends 604, 606 may have a saw tooth or other profile defined by the peaks and valleys, as appropriate.

FIGS. 6-9 illustrate modular actuator assembly 170 according to some embodiments. The right half of each figure depicts the rotational locking features of the embodiment of FIG. 4. The left half of each figure depicts the rotational locking features of the embodiment of FIG. 5. Referring to FIGS. 6-9, as mentioned briefly above, modular actuator assembly 170 may be selected from a number of varying interchangeable actuators, depending on the formation, drill bit, and needs of the operator. Some such actuators may require a source of electrical power to function and therefore may include an electrical generator subassembly 300.

Thus, according some embodiments, shaft 130 may include a plurality of recesses or grooves formed therein about the circumference and along an axial length of the shaft. Within each recess, a permanent magnet 210 may be affixed. Permanent magnets 210 may provide an alternating magnetic field as shaft 130 rotates with respect to electrical windings 308 located within electrical generator subassembly 300 of modular actuator assembly 170 for generation of electrical power.

Permanent magnets 210 may be arranged so as to create any even number of alternating magnetic poles about the circumference of shaft 130. In a first example as shown in the right half of FIG. 9 (also shown in FIG. 4), elongated longitudinal rows of disk-shaped magnets 210 may be provided, with each magnet being seated in a discrete circular recess with its north and south poles radially oriented. The axial rows may be evenly distributed about the circumference of shaft 130. All of magnets 210 in a given longitudinal row may share the same radial magnetic orientation, and longitudinal rows may define alternating north and south poles about the circumference of shaft 130.

Figure 9:
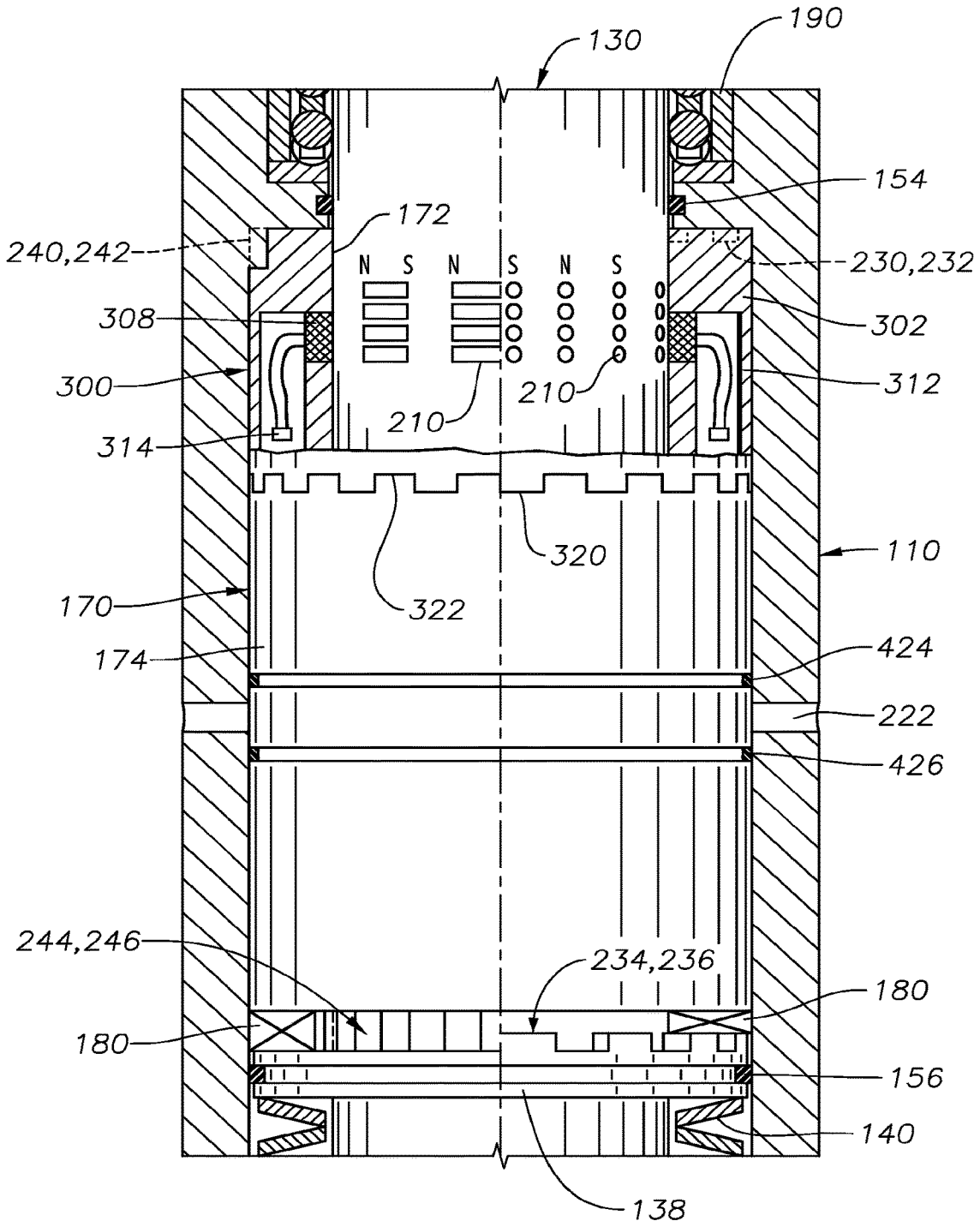
FIG. 9 is an enlarged axial cross section of a portion of the downhole oscillation tool of FIG. 6, showing the axial alignment of the shaft with respect to the electrical generator subassembly.

In a second example as shown in the right half of FIG. 9 (also shown in FIG. 5), a number of circumferential grooves may be formed along a length of shaft 130. Within each circumferential groove, a number of arc-shaped magnets 210 may be seated. Arc-shaped magnets 210 may have a radial or approximated radial magnetic orientation, or they may have a circumferential or approximated circumferential magnetic orientation. Regardless, arc-shaped magnets 210 may be positioned so as define longitudinally elongate, alternating north and south poles about the circumference of shaft 130.

Magnets 210 may define any even number of alternating magnetic poles about the circumference of shaft 130. A larger number of poles, for example, twelve, may allow for effective voltage generation at lower rotational speeds of shaft 130. Additionally, careful selection and orientation of magnets 210 may minimize cogging effects. In an embodiment, neodymium iron boron magnets 210 may be used, as neodymium iron boron is among the strongest magnet material currently commercially produced. However, other types of magnets may be used as appropriate.

Electrical generator subassembly 300 may form a part of modular actuator assembly 170 for providing electrical power and/or a tachometer signal for oscillation control purposes to modular actuator assembly 170. Generator subassembly 300 may include a cylindrical generator body 302 having an outer diameter so as to be slidingly received within housing 110. Generator subassembly 300 may be arranged to be rotationally fixed with respect to housing 110. A first end of generator body 302 may include hirth teeth 232 to mesh with hirth teeth 230 of shoulder 118 (illustrated in the right halves of FIGS. 6-9), or an outer circumference of generator body 302 may include an external spline fitting 242 to mesh with internal spline fitting 240 of housing 110 (illustrated in the left halves of FIGS. 6-9), for example. Generator body 302 may include an axial bore 172 formed therethrough to accommodate shaft 130.

A ring-shaped electrical armature winding assembly 308 may be provided about a circumference of axial bore 172 so as to be axially aligned and therefore magnetically coupled with magnets 210 when downhole oscillation tool 100 is assembled. Accordingly, in such embodiments, electrical generator subassembly 300 may more particularly be categorized as a permanent magnet alternator, because a permanent magnetic field is rotated within stator armature windings. Magnets 210 may be distributed on shaft 130 so that the effective axial length of the magnetic poles is longer than and extends upward of winding assembly 308. Therefore, as shaft 130 is axially displaced downward with respect to housing 110 by modular actuator assembly 170, the magnetic flux coupling between the rotor poles and winding assembly 308 may be maintained.

Although not expressly illustrated in detail, armature winding assembly 308 may include a laminated ferromagnetic core defining inward-facing radial slots, in which electrical conductors are wound. The number of armature poles and arrangement of the core and windings may be varied as appropriate to produce desired electrical generation characteristics.

Generator body 302 may include or define one or more compartments 312 for access to the electrical terminals of armature winding assembly 308. Rectifiers, voltage regulators, and other circuitry, components, and/or connectors 314 for interconnecting and controlling and modular actuator assembly 170 may be mounted within compartment 312. Two such circular compartments 312 arc illustrated, but other shapes and numbers of compartments 312 may be used as appropriate.

In some embodiments, modular actuator assembly 170 may include generator subassembly 300 and an interchangeable actuator subassembly 174, which be a hydraulic, electric, or electronic actuator subassembly, as described in greater detail below. Generator subassembly 300 may be electrically connected with actuator subassembly 174 for providing power and/or control to actuator subassembly 174. For this reason, it may be advantageous for actuator subassembly 174 to be rotationally fixed with respect to generator subassembly 300. Accordingly, a mating end of generator body 302 may also include hirth teeth 320 to mesh with hirth teeth 322 of actuator subassembly 174.

Alternatively, although not expressly illustrated, a spline junction between actuator section 174 and housing 110, longitudinal pins and sockets, serrations, keyed joints, or the like may be provided to prevent relative rotation between generator subassembly 300 and actuator subassembly 174.

Unlike mechanical actuator assembly 170 of FIGS. 4 and 5, in which lower sleeve 602 must remain rotationally locked with shaft 130, a modular actuator assembly 170 that includes generator subassembly 300 and an interchangeable actuator subassembly 174 may not need to be rotationally locked with shaft. Accordingly, such modular actuator assemblies 170 may include a flange bearing or bushing assembly 180 that may promote free rotation between flange 138 and modular actuator assembly 170.

In some embodiments, modular actuator assembly 170 may be hydraulically operated. Generally, referring back to FIGS. 1-3, pressurized drilling fluid from interior 33 of drill string 32 may flow into the hollow interior of shaft 130. This drilling fluid may then selectively enter modular actuator assembly 170 through elongated ports 220 in shaft 130 and may axially displace a piston within a hydraulic cylinder, which may in turn displace flange 138 with respect to housing 110. Thereafter, the pressurized fluid within the hydraulic cylinder may be vented to the lower pressure wellbore annulus 66 via ports 222 formed through housing 110, thereby allowing spring 140 to return flange 138 to the initial position. This cycle may be repeated to oscillate drill bit 80.

Figure 10:
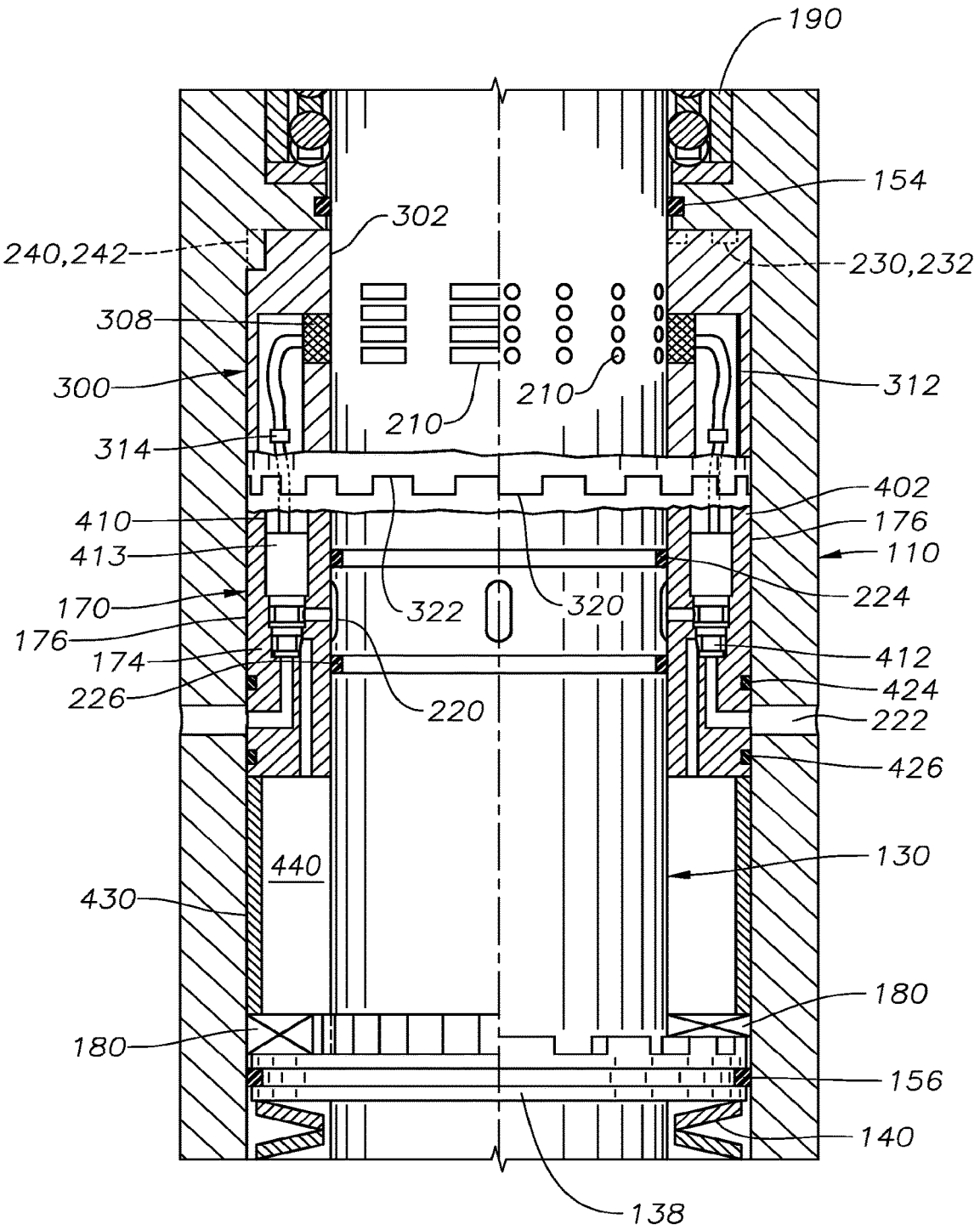
FIG. 10 is an enlarged axial cross section of a portion of the downhole oscillation tool according to some embodiments, shown equipped with a hydraulic modular actuator assembly defining an annular hydraulic cylinder.
Figure 10A:
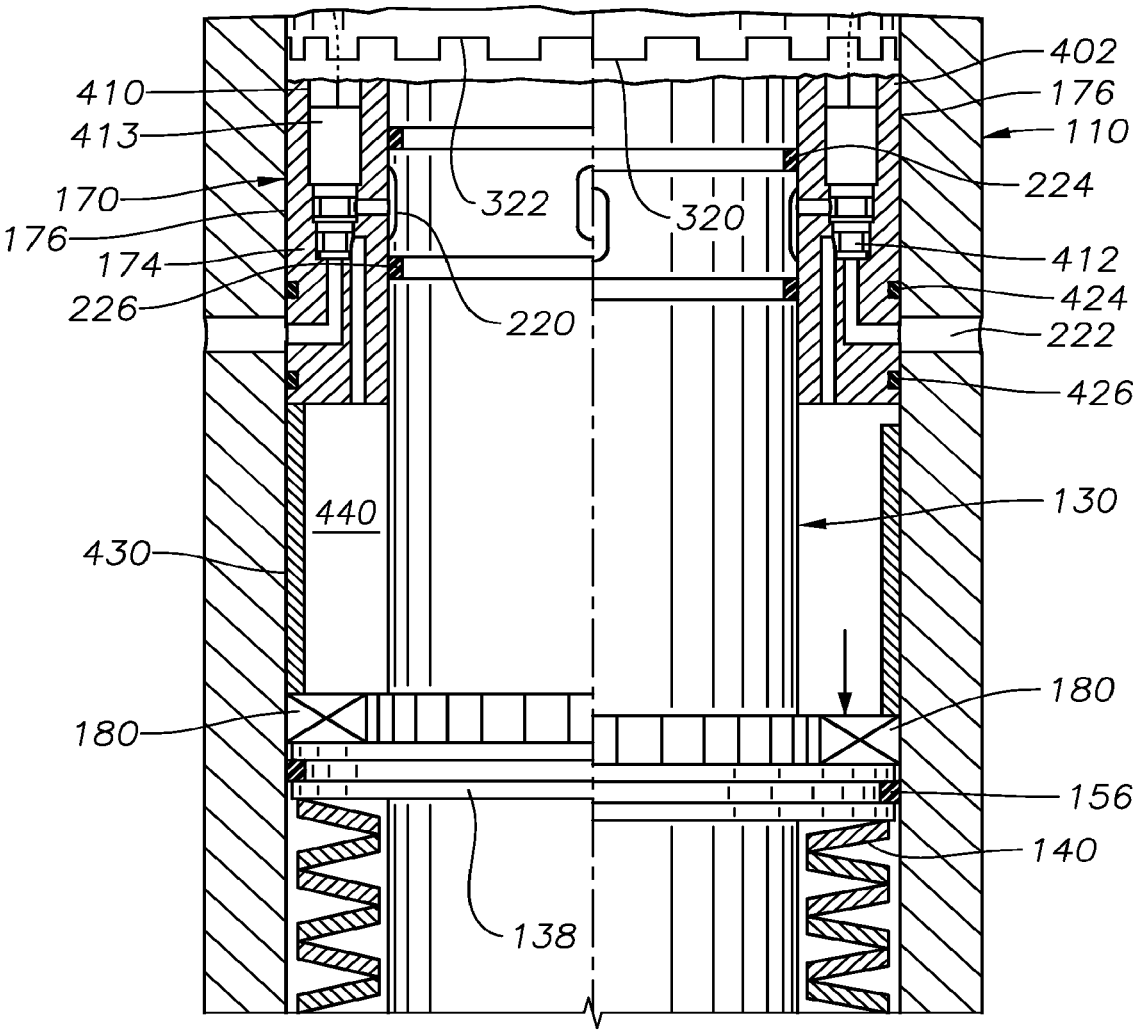
FIG. 10A is an enlarged axial cross section of the portion of the downhole oscillation tool of FIG. 10, with the right half showing the shaft axially displaced by the hydraulic modular actuator assembly with respect to the housing.

FIG. 10 illustrates modular actuator assembly 170 with a hydraulically powered interchangeable actuator subassembly 174 according to an embodiment. The right half of FIG. 10 depicts the rotational locking features of the embodiment of FIG. 4. The left half of FIG. 10 depicts the rotational locking features of the embodiment of FIG. 5. FIG. 10A illustrates modular actuator assembly 170 of FIG. 10 with the rotational locking features of the embodiment of FIG. 4. The left half of FIG. 10A depicts downhole oscillation tool 100 in a contracted state, with spring 140 forcing flange 138 against modular actuator assembly 170. The right half of FIG. 10A depicts downhole oscillation tool 100 in an axially expanded state, with modular actuator assembly 170 forcing flange 138 to compress spring 140.

Figure 11:
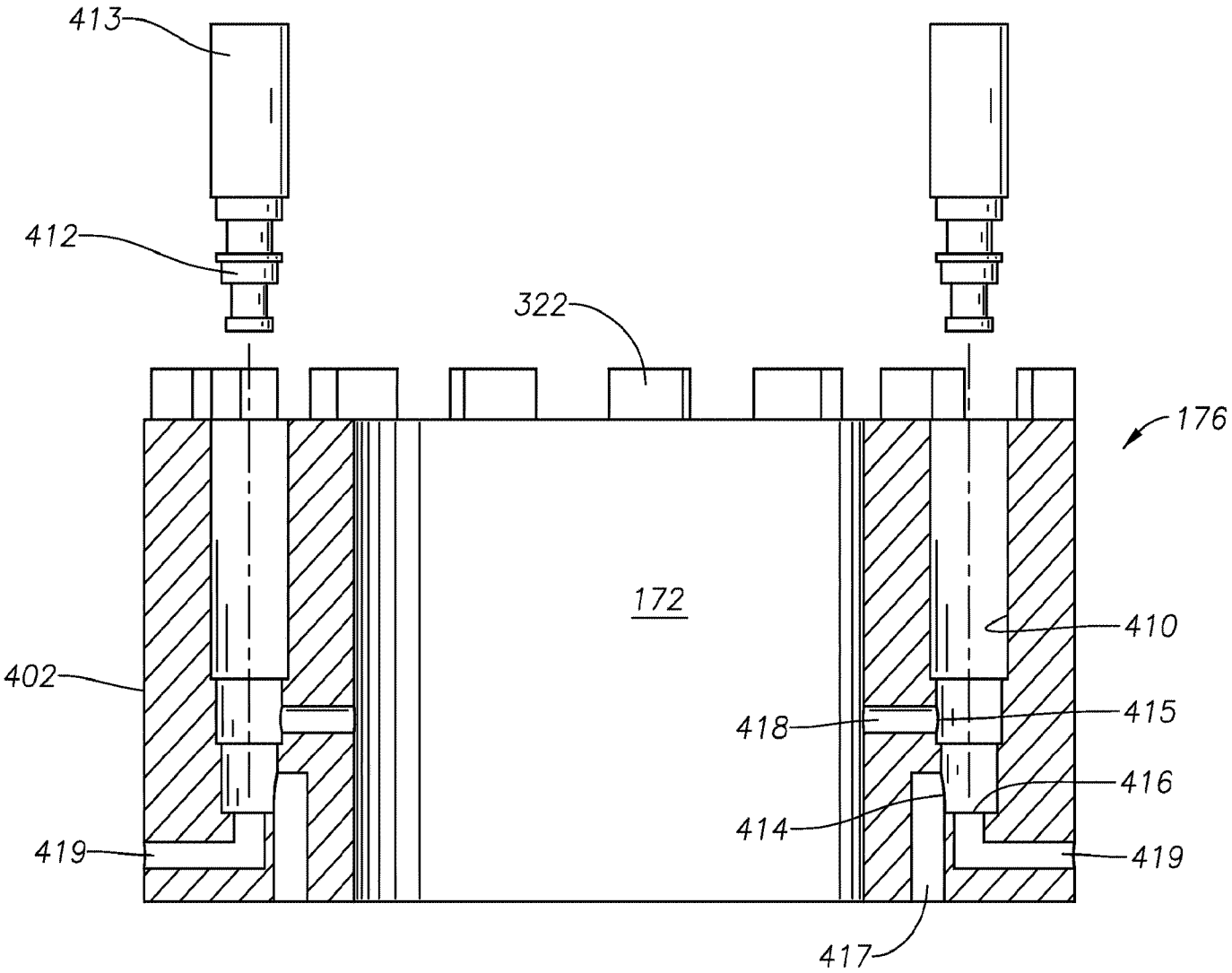
FIG. 11 is an enlarged axial cross section of a valve subassembly of a hydraulic modular actuator assembly according to some embodiments.

Actuator subassembly 174 may include a valve subassembly 176. FIG. 11 illustrates a valve subassembly 176 in greater detail. Referring to FIGS. 10, 10A, and 11, valve subassembly 176 may include a cylindrical valve body 402 having an outer diameter so as to be slidingly received within housing 110. Valve subassembly 176 may be arranged to be rotationally fixed with respect to generator subassembly 300. For this reason, a first, mating end of valve body 402 may include hirth teeth 322 to mesh with hirth teeth 320 of shoulder generator subassembly 300, or an outer circumference of valve body 402 may include an external spline fitting (not illustrated) to engage and rotationally lock valve body 402 within housing 110. Other locking arrangements, including serrations, keyed joints, longitudinal pins and sockets, and the like, may also be used. Valve body 402 may include an axial bore 172 formed therethrough to accommodate shaft 130.

Valve body 402 may include one or more mounting cavities 410 formed therein, into which directional hydraulic valves 412 may be received. In the embodiment illustrated, two such mounting cavities 410 are provided, although a differing number may be used. In an embodiment, each valve 412 may be a three-port, two-position valve that either hydraulically couples a common port 414 either to a supply port 415 or to a vent port 416. However, separate two-port valves (not illustrated) may be used to provide this three-port functionality. Valve 412 may be a spool valve or a poppet valve. In an embodiment, valve 412 may be operated by a solenoid 413 and be powered and controlled by generator subassembly 300. However, in another embodiment (not illustrated), valve subassembly 176 may use completely hydraulically or mechanically controlled and actuated valves in place of solenoid operated valves. In such an embodiment, generator subassembly 300 may not be necessary.

For each mounting cavity 410, a longitudinal conduit 417 may be formed within valve body 402 to fluidly connect common port 414 to one or more hydraulic cylinders, as described in more detail below. An inner radial conduit 418 may be formed in valve body 402 between supply port 415 and axial bore 172. Inner radial conduit 418 may be located so that when downhole oscillation tool 100 is assembled, conduit 418 axially aligns and is fluidly coupled with elongate ports 220 in shaft 130. Ports 220 may be longitudinally elongate to allow limited axial displacement of shaft 130 with respect to valve body 402 while maintaining fluid communication with conduit 418. Upper and lower inner actuator seals 224, 226 may be provided above and below ports 220 between shaft 130 and axial bore 172 of modular actuator 170. Inner actuator seals 224, 226 may be arranged to seal against the interior wall of bore 172 while allowing both rotary and limited axial movement of shaft 130 within bore 172.

Similarly, an outer radial conduit 419 may be formed in valve body 402 between vent port 416 and the exterior cylindrical wall of valve body 402. Outer radial conduit 419 may be located so that when downhole oscillation tool 100 is assembled, conduit 419 axially aligns and is fluidly coupled with ports 222 in housing 110. Upper and lower outer actuator seals 424, 426 may be provided about exterior cylindrical wall of valve body 402 above and below outer radial conduit 419. Outer actuator seals 424, 426 may be arranged to seal against the interior wall of housing 110. Outer actuator seals 424, 426 may be metallic, ceramic, elastomeric, or polymeric, for example.

In an embodiment, as shown in FIG. 10, hydraulic actuator subassembly 174 may define a single ring-shaped hydraulic cylinder 440. Specifically, valve body 402 may define a first end of hydraulic cylinder 440, with longitudinal conduit 417 opening into cylinder 440. The exterior wall of shaft 130 may define an inner wall of cylinder 440, and the interior wall of housing 110 may define the outer wall of cylinder 440. Flange 138 may act directly as a piston and thereby define the, second, movable end of hydraulic cylinder 440. A spacer ring 430 may be provided between valve body 402 and flange 138 and provide a minimum cylinder volume.

Figure 12:
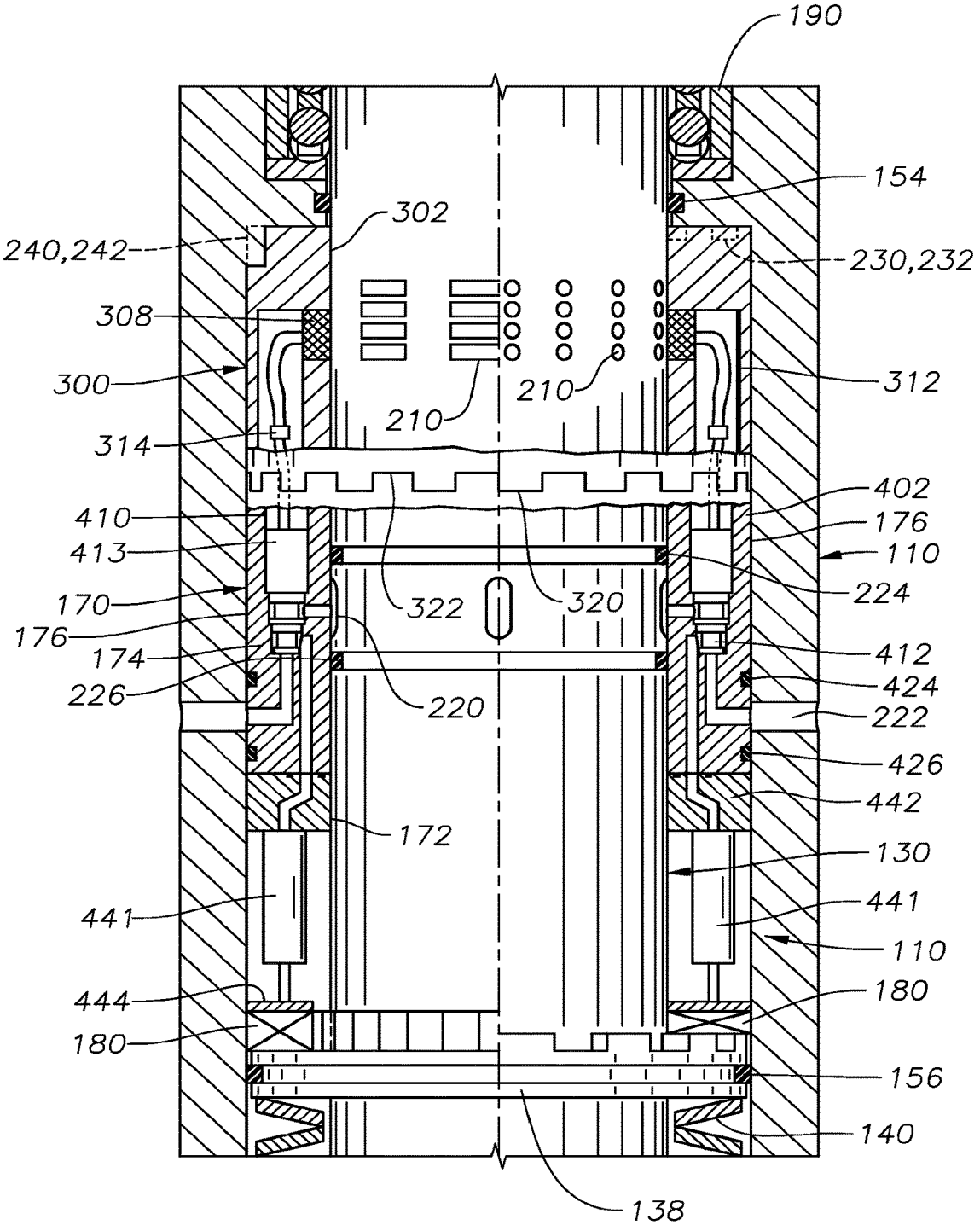
FIG. 12 is an enlarged axial cross section of a portion of the downhole oscillation tool according to some embodiments, shown equipped with a hydraulic modular actuator assembly having an annular arrangement of individual hydraulic cylinders.
Figure 12A:
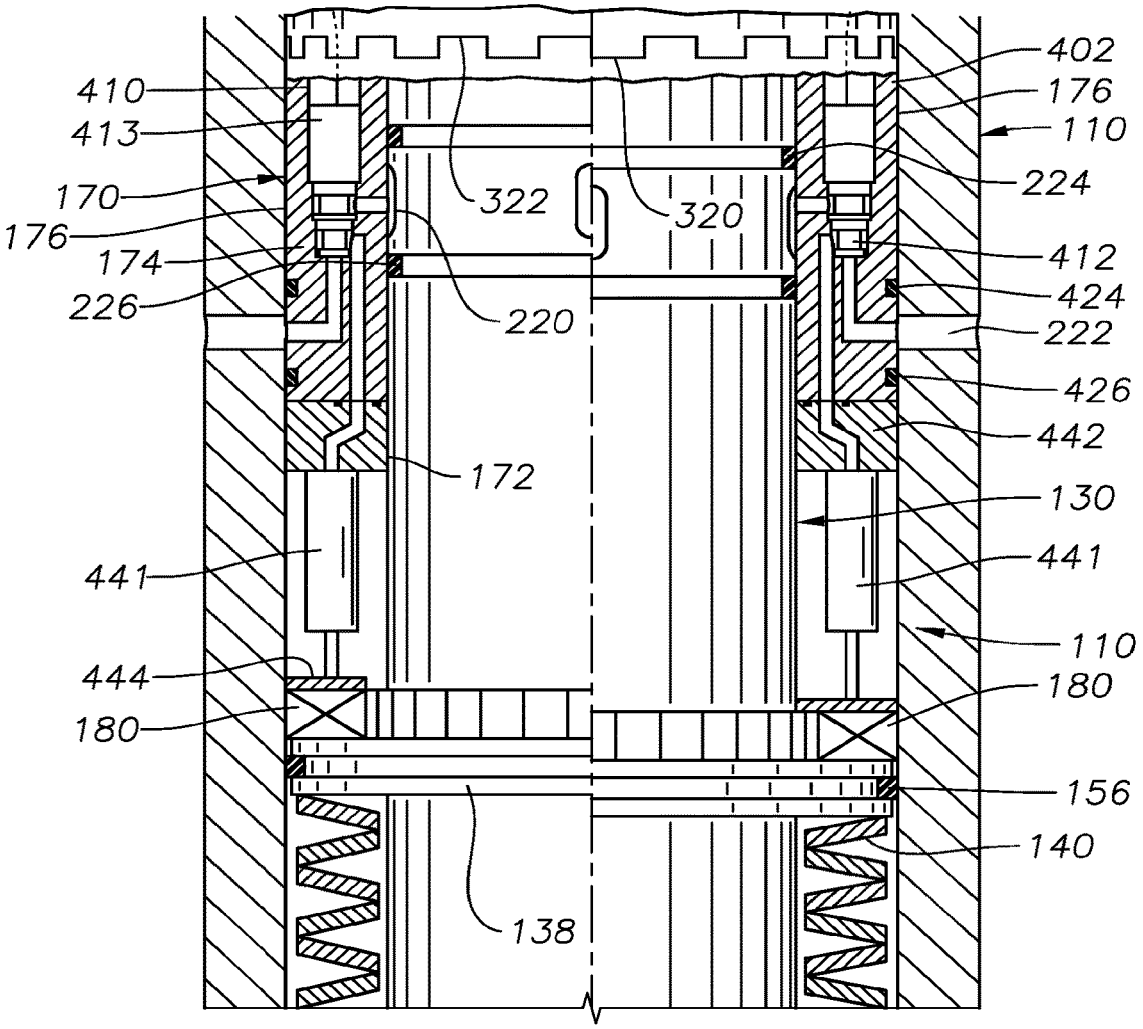
FIG. 12A is an enlarged axial cross section of the portion of the downhole oscillation tool of FIG. 12, with the right half showing the shaft axially displaced by the hydraulic modular actuator assembly with respect to the housing.

In another embodiment, as shown in FIGS. 12 and 12A, hydraulic actuator subassembly 174 may include a number of discrete hydraulic cylinders 441 circularly positioned and longitudinally connected between a ring-shaped hydraulic manifold 442 and a ring-shaped load plate 444. The right half of FIG. 12 depicts the rotational locking features of the embodiment of FIG. 4. The left half of FIG. 12 depicts the rotational locking features of the embodiment of FIG. 5. FIG. 12A illustrates modular actuator assembly 170 of FIG. 12 with the rotational locking features of the embodiment of FIG. 4. The left half of FIG. 12A depicts downhole oscillation tool 100 in a contracted state, with spring 140 forcing flange 138 against modular actuator assembly 170. The right half of FIG. 12A depicts downhole oscillation tool 100 in an axially expanded state, with modular actuator assembly 170 forcing flange 138 to compress spring 140.

Manifold 442 may include a circular flow path that fluidly couples each hydraulic cylinder 441 with longitudinal conduit(s) 417. When downhole oscillation tool 100 is assembled, load plate 444 may be seated and act against flange bearing or bushing assembly 180 to displace flange 138.

Although a hydraulic actuator subassembly 174 has been described that may include a number of discrete hydraulic cylinders 441 circularly positioned and longitudinally connected between upper and lower ring-shaped members, in another embodiment (not illustrated), such hydraulic actuators may be replaced by a circular array of electrical linear actuators, such as solenoids. In such an embodiment, electrical generator subassembly 300 may be used, but valve subassembly 176 may not be required.

Figure 13:
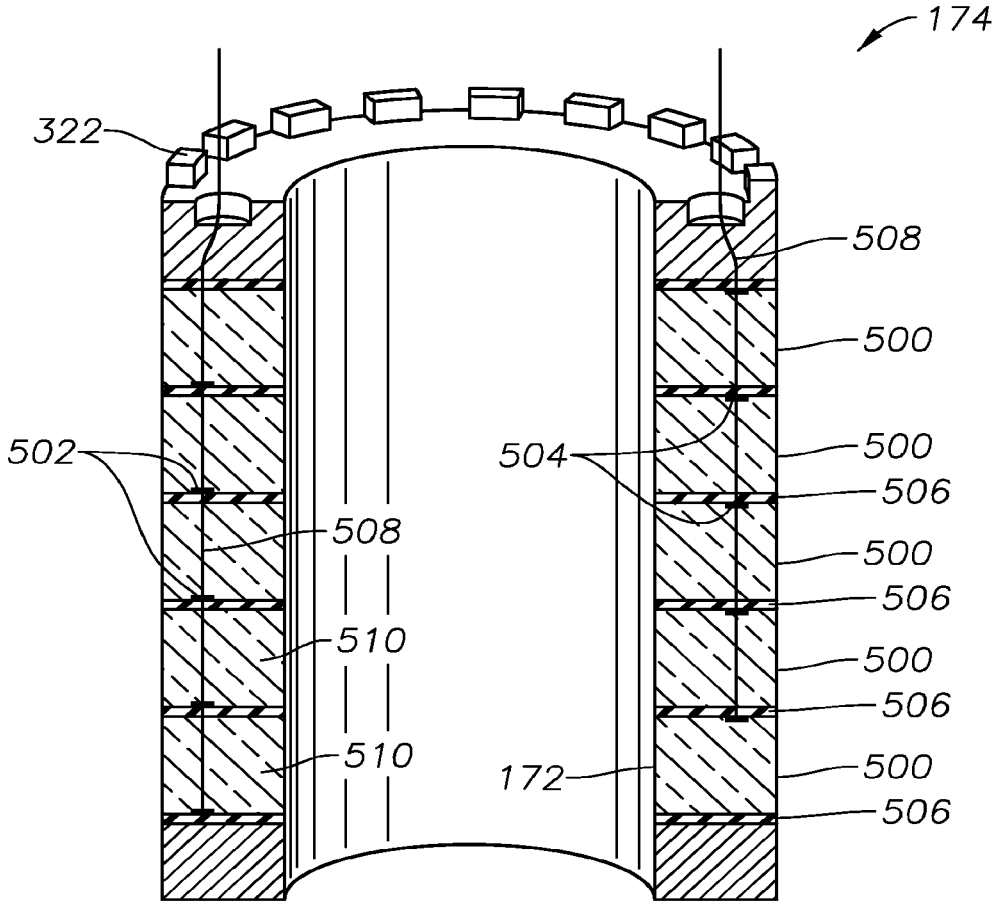
FIG. 13 is a perspective view in axial cross section of a piezoelectric modular actuator assembly according to some embodiments, showing a stack of ring-shaped expansion members.

FIG. 13 is a perspective view in axial cross section that illustrates an interchangeable piezoelectric actuator subassembly 174 according to an embodiment, which may be used in conjunction with generator subassembly 300 (FIGS. 6-9) to form an electronic modular actuator assembly 170. As with hydraulic actuator subassemblies 174 of FIGS. 10 and 12 above, piezoelectric actuator subassembly 174 may be powered and controlled by generator subassembly 300. Accordingly, a first end of piezoelectric actuator subassembly 174 may include hirth teeth 322 to engage with hirth teeth 320 of generator subassembly 300, or an outer circumference of piezoelectric actuator subassembly 174 may include an external spline fitting (not illustrated) to engage and rotationally lock within housing 110. Other locking arrangements, including serrations, keyed joints, longitudinal pins and sockets, and the like, may also be used. Piezoelectric actuator subassembly 174 may include an axial bore 172 formed therethrough to accommodate shaft 130.

In some embodiments, piezoelectric actuator subassembly 174 may include one or more washer-shaped or sleeve-shaped expansion members 500, which collectively may be axially, radially, or circumferentially stacked. An axial stack is illustrated in FIG. 13.

Each ring-shaped expansion member 500 may include one or more piezo elements 510. In the embodiment illustrated in FIG. 13, each expansion member 500 may include one ring shaped piezo element 510. However, other arrangements may also be used as appropriate.

The particular shapes, dimensions, and arrangements of expansion members 500 and piezo elements 510 may be varied to obtain desired resonant frequencies. Resonant frequencies may range between 200 kHz and 10 MHz, for example, to provide ultrasonic vibration of drill bit 80 (FIG. 1).

Each piezo element 510 may be formed of a ferroelectric ceramic material such as barium titanate ($BaTiO_3$) or lead zirconate titanate (PZT). Such ceramic materials may be commercially available in many variations and configurations. Additionally, piezo element 510 may be doped with ions, such as with nickel, bismuth, lanthanum, neodymium, and/or niobium, to optimize piezoelectric and dielectric properties.

Piezo element 510 may operate to expand along a predetermined direction by the inverse piezoelectric effect when an electrical voltage is applied across piezo element 510. The direction of expansion in ferroelectric ceramic piezo materials is determined by the macroscopic orientation of ferroelectric domains within the crystallites of the ceramic. The macroscopic orientation of ferroelectric domains may be set during manufacturing of piezo element 510 by a ferroelectric polarization process under a strong electric field so that piezoelectric actuator subassembly 174 expands axially within housing 110 (e.g., FIG. 6) to displace flange 138.

Figure 6:
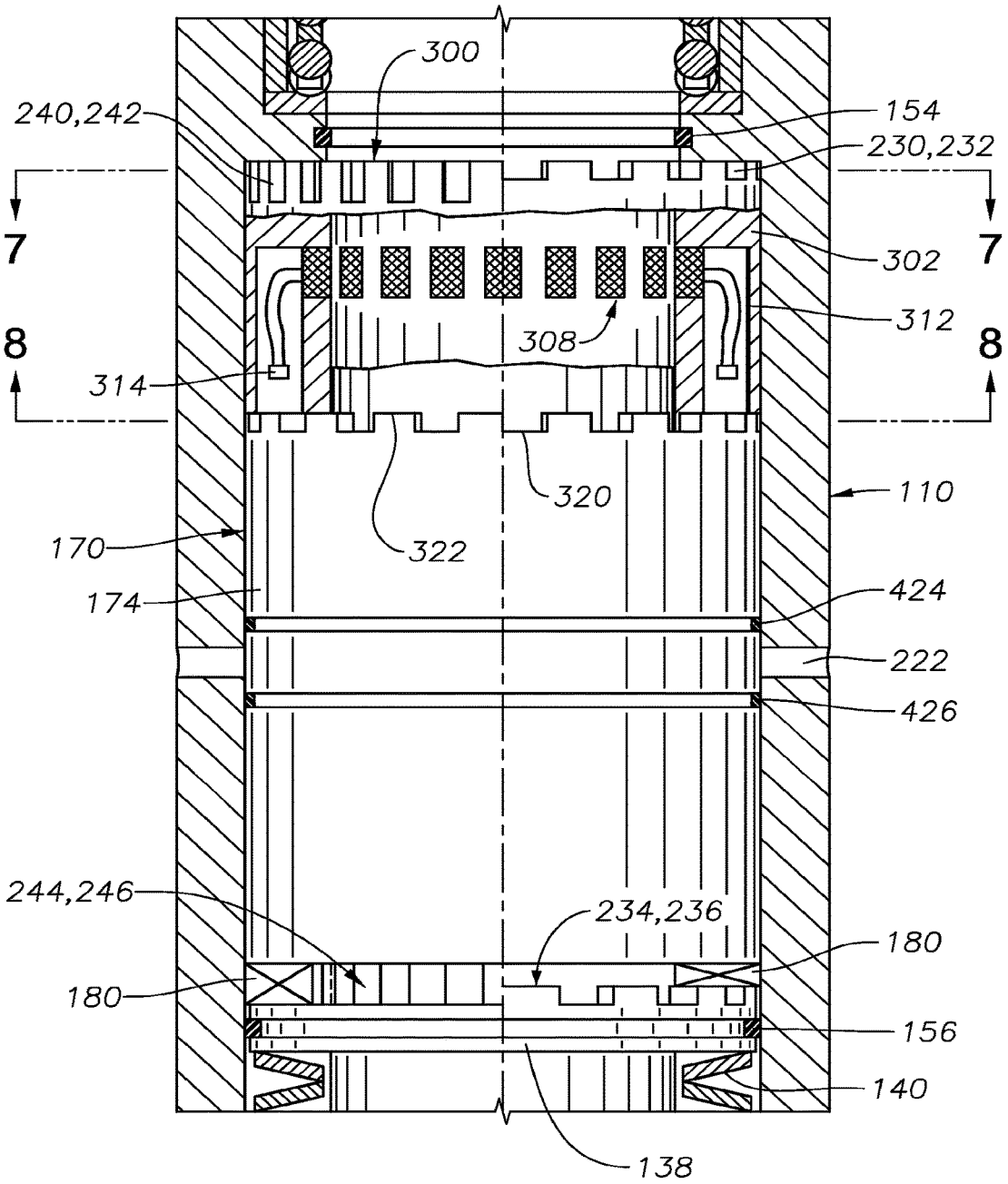
FIG. 6 is an enlarged axial cross section of a portion of a downhole oscillation tool according to some embodiments, shown with the shaft removed to reveal details of a modular actuator with an electrical generator subassembly.
Figure 7:
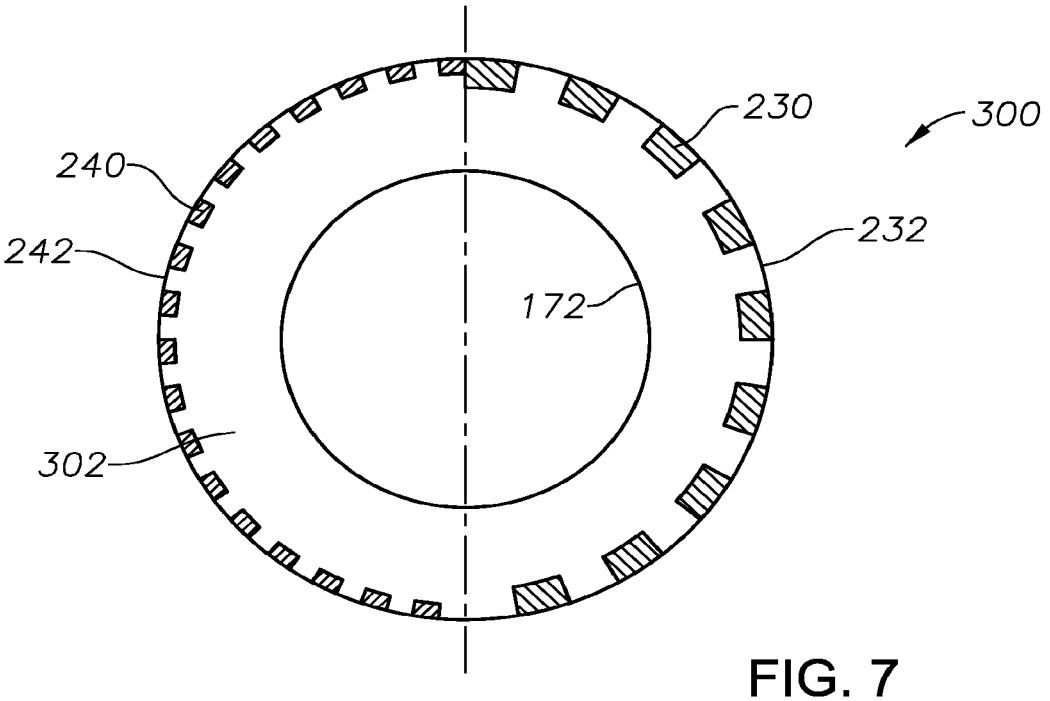
FIG. 7 is a transverse cross section of the downhole oscillation tool of FIG. 6 taken along lines 7-7 of FIG. 6.
Figure 8:
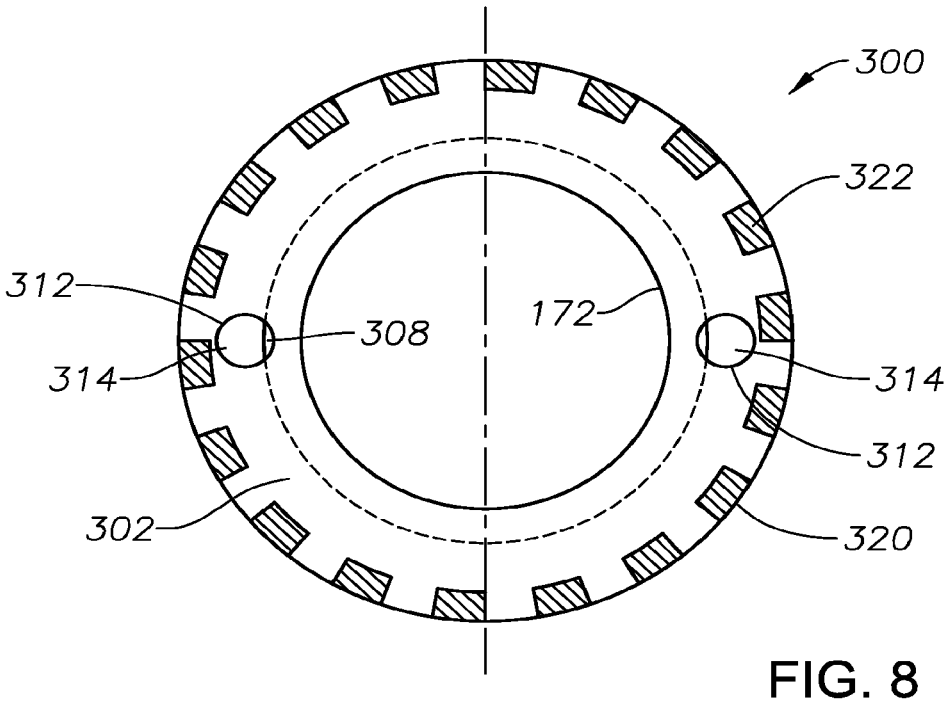
FIG. 8 is a transverse cross section of the downhole oscillation tool of FIG. 6 taken along lines 8-8 of FIG. 6.

Each piezo element 510 may include positive and negative electrodes 502, 504 located at opposite ends along the axis of expansion of the ceramic material. Piezo element 510 may also include dielectric layers 506 to allow for adjacent positioning of multiple piezo elements 510. Positive and negative electrodes 502, 504 may be connected by electrical conductors 508 to control circuitry 314 within generator subassembly 300 (FIG. 6).

Figure 14:
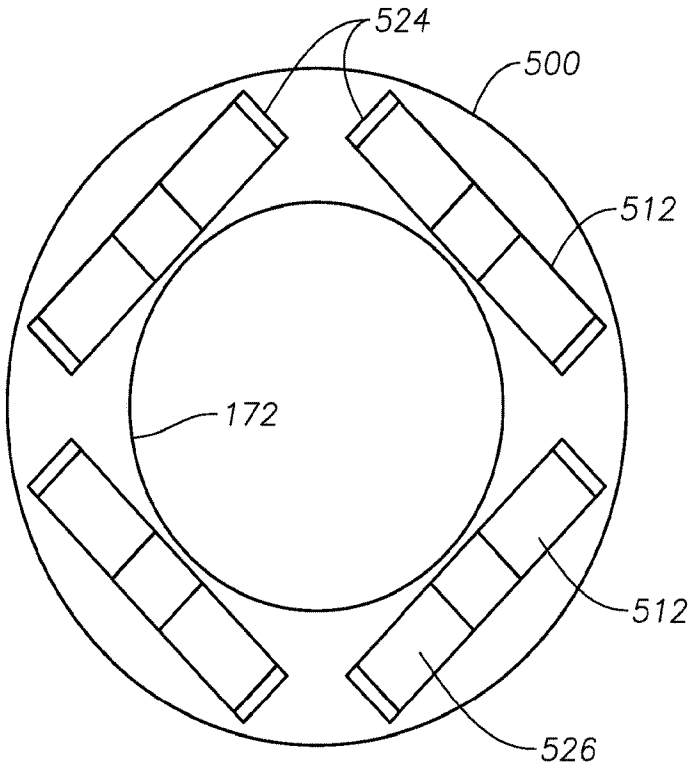
FIG. 14 is a plan view of a ring-shaped expansion member of a piezoelectric modular actuator assembly according to an embodiment, showing a number of flextensional actuation mechanisms.

FIG. 14 is a plan view of a ring-shaped expansion member 500 according to another embodiment. Each ring shaped expansion member 500 may include a number of flextensional actuation mechanisms 512. A number of expansion members 500 may be stacked with aligned flextensional actuation mechanisms 512 to form piezoelectric actuator subassembly 174.

Figure 15:
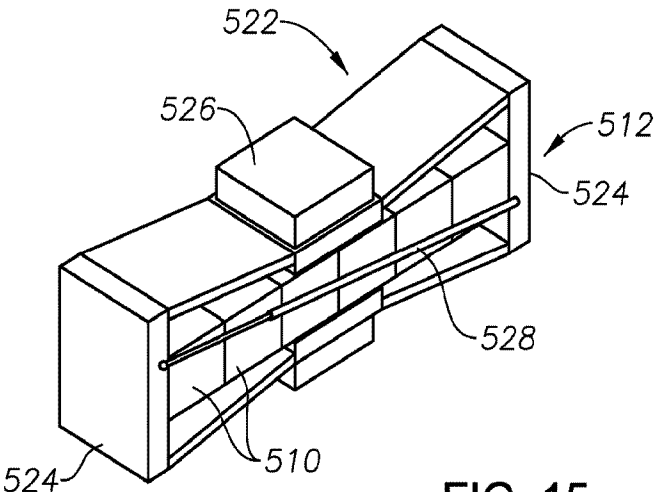
FIG. 15 is a perspective view of a flextensional actuation mechanism of FIG. 14 shown in a contracted state.
Figure 16:
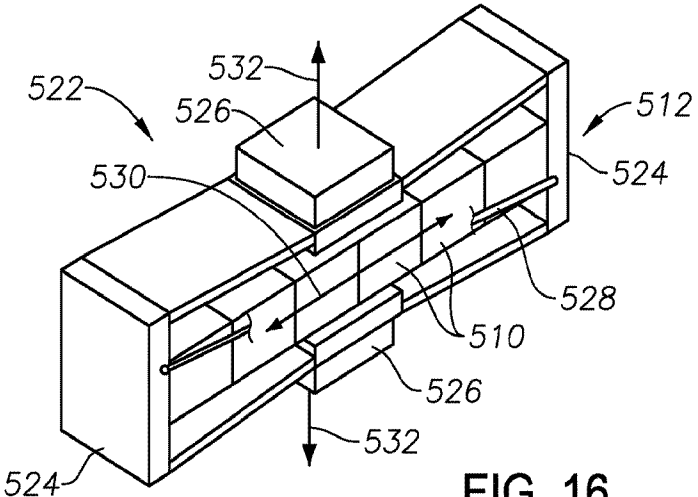
FIG. 16 is a perspective view of a fl extensional actuation mechanism of FIG. 14 shown in an expanded state.

FIG. 15 is a perspective view of a flextensional actuation mechanism 512 in a contracted state, and FIG. 16 is a perspective view of flextensional actuation mechanism 512 in an expanded state. Referring to FIGS. 15 and 16, each flextensional actuation mechanism 512 may include one or more piezo elements 510 located within a metal kinematic amplification frame 522. Amplification frame 522 may include end blocks 524 connected by metal flexure webs 526. Flexure webs 526 may function as frictionless hinges that are designed to flex within a designed fatigue stress limit. A spring wire 528 may be coupled between end blocks 524 to keep piezo elements 510 under a compressive preload. As shown in FIG. 16, when piezo elements 510 expand under an applied electric field in the longitudinal direction indicated by arrow 530, frame 522 expands transversely as indicated by arrows 532. However, flextensional actuation mechanisms 512 may be arranged for frame expansion under piezo element contraction, if desired.

Figure 17:
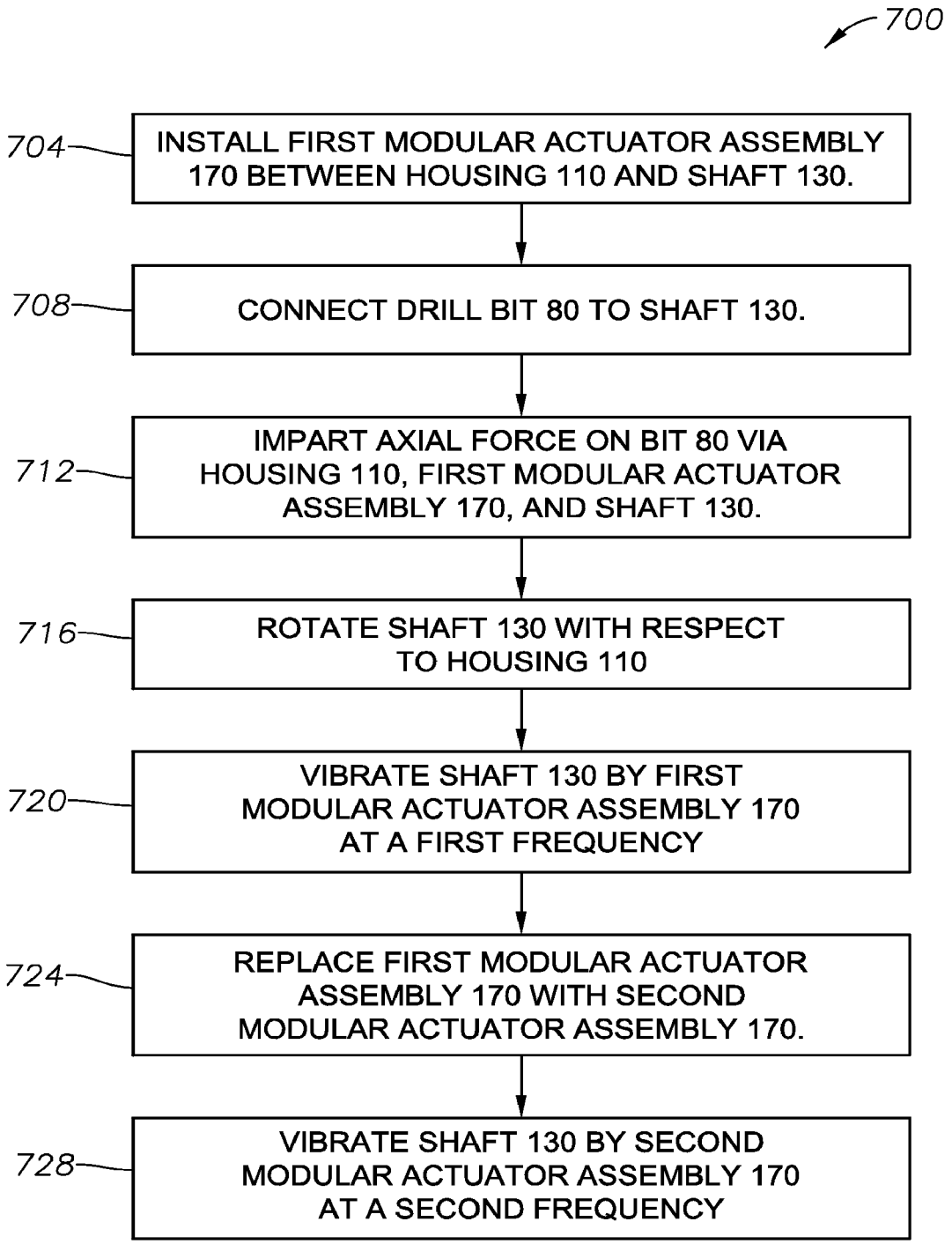
FIG. 17 is a flow chart of a method for axially vibrating a downhole drill bit according to an embodiment.

FIG. 17 is a flow chart of a method 700 for axially vibrating a downhole drill bit according to an embodiment. Referring to FIGS. 3 and 17, at step 704, a first modular actuator assembly 170 may be installed between housing 110 and shaft 130. Modular actuator assembly 170 may require a particular radial orientation within housing 110, for alignment of ports, etc. Proper radial alignment may be ensured through the use of indexed hirth teeth, spline fittings, keys, markings, or other indicia, for example.

Thereafter, downhole oscillation tool 100 is reassembled as illustrated in the exploded view of FIG. 3. In the particular illustrated embodiment, shaft 130 may be inserted through bore 172 of modular actuator assembly 170 until spline fitting 132 is slidingly received within spline fitting 134 of drive shaft 92. Next, spring 140 may be inserted into housing 110 and housing end cap 114 connected to housing 110.

At step 708, drill bit 80 may be installed to shaft 130 at connector 136. Downhole oscillation tool 100 may then be conveyed into wellbore 60 (FIG. 1). During drilling, at step 712, an axial force may be imparted on bit 80 via drill string 32, housing 110, the first modular actuator assembly 170, and shaft 130. Shaft 130 may be rotated with respect to housing 110, via mud motor drive shaft 92 for example, as shown in step 716. At step 720, shaft 130 may be oscillated by the first modular actuator assembly 170 at a first frequency as shaft 130 is rotated with respect to housing 110.

As drilling continues, various parameters associated with the drilling may be monitored. These parameters may relate to one or more of the following: Drill string, wellbore fluid, wellbore cuttings, formation fluid, wellbore, and formation composition. Based on one or more of these parameters, or a change in these parameters, it may be determined that a different modular actuator should be used. For example, a change in the rock face at the bottom of the wellbore may dictate that at modular actuator operable at a different frequency is required in order to maximize ROP during the drilling process. The foregoing monitoring may occur in-situ or at the surface, and is not limited to any particular type of monitoring device. In any event, based on a determination that a different modular actuator is needed, at steps 724 and 728, respectively, downhole oscillation tool 100 may be removed from wellbore 60 and disassembled. The first modular actuator assembly 170 may be replaced with a second modular actuator assembly 170, and downhole oscillation tool may be reassembled and run back into wellbore 60 (FIG. 1). Thereafter, shaft 130 may be oscillated by the second modular actuator assembly 170 at a second frequency as shaft 130 is rotated with respect to housing 110.

Alternatively, in the case of some embodiments of modular actuator assembly 170, such as electric, piezoelectric, and hydraulic arrangements, control circuitry 314 (e.g., FIG. 6) may allow for adjustment of vibration frequency in situ without the requirement to trip downhole oscillation tool 100 out of wellbore 13 (FIG. 1). Various telemetry techniques, including mud pulse telemetry, wire-in-pipe, and the like, may be used to communicate with control circuitry 314 from the surface.

Figure 18:
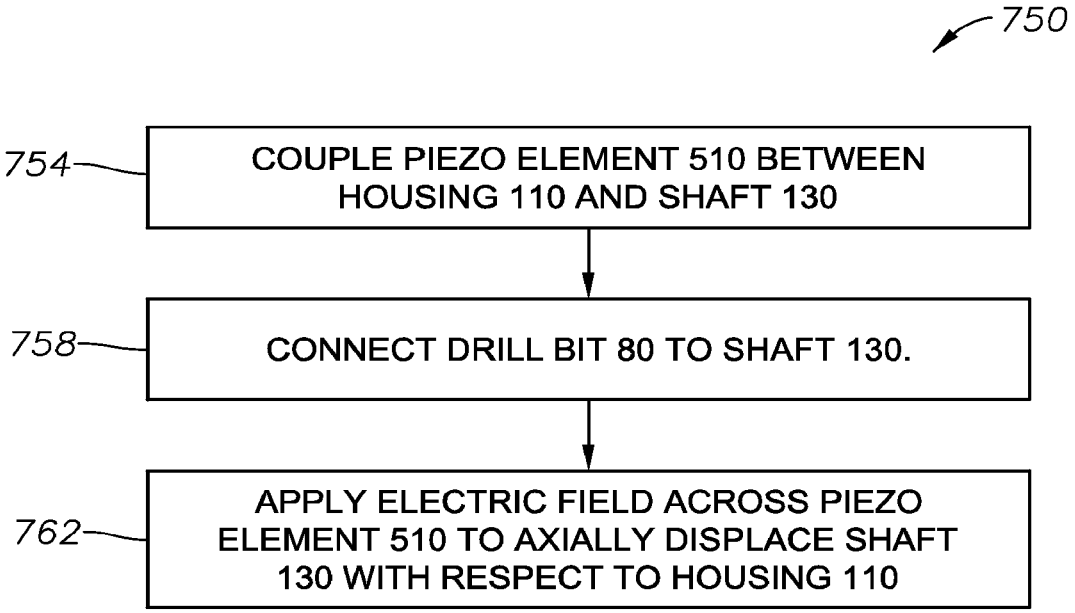
FIG. 18 is a flow chart of a method for axially vibrating a downhole drill bit according to another embodiment.

FIG. 18 is a flow chart of a method 750 for axially vibrating a downhole drill bit according to another embodiment. Referring to FIGS. 3 and 18, at step 754, a piezo element 510 may be provided between housing 110 and shaft 130. Piezo element 510 need not be modular or interchangeable in design. In some embodiments, multiple piezo elements may be provided in the form of one or more washer-shaped or sleeve-shaped expansion members 500, which collectively may be axially, radially, or circumferentially stacked. An axial stack is illustrated in FIG. 13. Each ring-shaped expansion member 500 may include one or more piezo elements 510. In the embodiment illustrated in FIG. 13, each expansion member 500 may include one ring shaped piezo element 510. However, other arrangements may also be used as appropriate.

The particular shapes, dimensions, and arrangements of expansion members 500 and piezo elements 510 may be varied to obtain desired resonant frequencies. Resonant frequencies may range between 200 kHz and 10 MHz, for example, to provide ultrasonic vibration of drill bit 80.

Each piezo element 510 may be formed of a ferroelectric ceramic material such as barium titanate ($BaTiO_3$) or lead zirconate titanate (PZT). Such ceramic materials may be commercially available in many variations and configurations. Additionally, piezo element 510 may be doped with ions, such as with nickel, bismuth, lanthanum, neodymium, and/or niobium, to optimize piezoelectric and dielectric properties.

FIG. 14 is a plan view of a ring-shaped expansion member 500 according to another embodiment. Each ring shaped expansion member 500 may include a number of flextensional actuation mechanisms 512. A number of expansion members 500 may be stacked with aligned flextensional actuation mechanisms 512 to form piezoelectric actuator subassembly 174.

FIG. 15 is a perspective view of a flextensional actuation mechanism 512 in a contracted state, and FIG. 16 is a perspective view of flextensional actuation mechanism 512 in an expanded state. Referring to FIGS. 15 and 16, each flextensional actuation mechanism 512 may include one or more piezo elements 510 located within a metal kinematic amplification frame 522. Amplification frame 522 may include end blocks 524 connected by metal flexure webs 526. Flexure webs 526 may function as frictionless hinges that are designed to flex within a designed fatigue stress limit. A spring wire 528 may be coupled between end blocks 524 to keep piezo elements 510 under a compressive preload. As shown in FIG. 16, when piezo elements 510 expand under an applied electric field in the longitudinal direction indicated by arrow 530, frame 522 expands transversely as indicated by arrows 532. However, flextensional actuation mechanisms 512 may be arranged for frame expansion under piezo element contraction, if desired.

Referring back to FIGS. 3 and 18, at step 758, drill bit 80 may be installed to shaft 130 at connector 136. Thereafter, downhole oscillation tool 100 may be lowered into wellbore 13 (FIG. 1). Thereafter an electric field may be applied across piezo element 510 to axially displace shaft 130 with respect housing 110. More particularly, an oscillating electric field may be applied to oscillate drill bit 80.

Piezo element 510 may operate to expand along a predetermined direction by the inverse piezoelectric effect when an electrical voltage is applied across piezo element 510. The direction of expansion in ferroelectric ceramic piezo materials is determined by the macroscopic orientation of ferroelectric domains within the crystallites of the ceramic. The macroscopic orientation of ferroelectric domains may be set during manufacturing of piezo element 510 by a ferroelectric polarization process under a strong electric field so that piezo element 510 causes axial expansion to displace flange 138.

Each piezo element 510 may include positive and negative electrodes 502, 504 located at opposite ends along the axis of expansion of the ceramic material. Piezo element 510 may also include dielectric layers 506 to allow for adjacent positioning of multiple piezo elements 510. Positive and negative electrodes 502, 504 may be connected by electrical conductors 508 to control circuitry 314 within a generator subassembly 300 (e.g., FIG. 6). However, other arrangements for providing electric power may be used, including batteries, wire-in-pipe, etc.

As drilling continues, various parameters associated with the drilling may be monitored. These parameters may relate to one or more of the following: Drill string, wellbore fluid, wellbore cuttings, formation fluid, wellbore, and formation composition. Based on one or more of these parameters, or a change in these parameters, it may be determined that a vibration frequency should be used. For example, a change in the rock face at the bottom of the wellbore may dictate that at modular actuator operable at a different frequency is required in order to maximize ROP during the drilling process. The foregoing monitoring may occur in-situ or at the surface, and is not limited to any particular type of monitoring device. Control circuitry 314 (e.g., FIG. 6) may allow for adjustment of vibration frequency in situ without the requirement to trip downhole oscillation tool 100 out of wellbore 13 (FIG. 1). Various telemetry techniques, including mud pulse telemetry, wire-in-pipe, and the like, may be used to communicate with control circuitry 314 from the surface.

In summary, downhole oscillation tool, a system, and a method for axially vibrating a downhole drill bit have been described. Embodiments of an oscillation tool may generally have: A tubular housing; a shaft partially disposed within the housing and extending beyond a bottom end of the housing, the shaft being rotatively and axially movable with respect to the housing; and a modular actuator assembly interchangeably carried within the housing and disposed to axially oscillate the shaft with respect to the housing as the shaft rotates with respect to the housing. Embodiments of a system may generally have: A tubular housing; a shaft partially disposed within the housing and extending beyond a bottom end of the housing, the shaft being rotatively and axially movable with respect to the housing; and a plurality of interchangeable modular actuator assemblies each interchangeably securable within the housing and when so secured, disposed to axially oscillate the shaft with respect to the housing as the shaft rotates with respect to the housing. Embodiments of a method may generally include: Installing an interchangeable first modular actuator assembly between a housing and a shaft; connecting the drill bit to a distal end of the shaft; imparting an axial force on the drill bit via the housing, the first modular actuator, and the shaft; rotating the shaft with respect to the housing; and axially vibrating the shaft at a first frequency with respect to the housing by the first modular actuator assembly as the shaft rotates with respect to the housing.

Any of the foregoing embodiments may include any one of the following elements or characteristics, alone or in combination with each other: A ring-shaped shoulder formed around an interior circumference of the housing; a flange formed about an outer circumference of the shaft, the flange located within the housing; a spring disposed within the housing so as to bias the flange towards the shoulder; the modular actuator assembly is interchangeably carried between the shoulder and the flange and disposed to axially oscillate the piston with respect to the shoulder against the spring as the shaft rotates with respect to the housing; the modular actuator assembly includes an axial bore formed therethrough; the shaft passes through the bore; at least a portion of the modular actuator assembly is rotationally fixed with respect to the housing by one of the group consisting of at least a hirth joint, a spline, a serration, and a keyed joint; an electrical generator disposed within the housing and coupled so as to provide power to the modular actuator assembly; a winding of the electrical generator is disposed within the modular actuator assembly; the shaft carries at least one magnet; the modular actuator assembly includes at least one coil rotatively fixed with respect to the housing and inductively coupled with the at least one magnet so as to generate an electrical potential by rotation of the shaft with respect to the housing; the modular actuator assembly is one from a group consisting of at least a mechanical actuator assembly, a hydraulic actuator assembly, and a piezoelectric actuator assembly; a first sleeve arranged so as to be rotationally fixed with respect to the housing and having a shaped end with a plurality of longitudinal peaks intervaled by a plurality of longitudinal valleys; a second sleeve arranged so as to be rotationally fixed with respect to the shaft and having a shaped end with a plurality of longitudinal peaks intervaled by a plurality of longitudinal valleys, the shaped end of the second sleeve engaging the shaped end of the first sleeve; one of the group consisting of at least a hirth joint, a spline, a serration, and a keyed joint rotationally fixing the second sleeve to the shaft; the shaft is hollow and defines an interior; the hydraulic actuator assembly includes or at least partially defines a hydraulic cylinder operable to impose an axial force on the shaft with respect to the housing, a first flow path hydraulically coupled between the interior of the shaft and the hydraulic cylinder, and a second flow path hydraulically coupled between the hydraulic cylinder and an exterior of the housing; the hydraulic cylinder includes a piston formed about an outer circumference of the shaft and dynamically sealed against an inner wall of the housing; the hydraulic cylinder includes a plurality of discreet hydraulic cylinders disposed about the shaft within the housing; a valve operatively disposed in at least one of the first and second flow paths so as to control a pressure in the hydraulic cylinder; the piezoelectric actuator includes at least one ring-shaped expansion member with at least one piezo element; the at least one piezo element is ring-shaped and characterized by axial expansion under an applied electric field; the at least one ring-shaped expansion member includes a flextensional mechanism; the at least one piezo element is operatively coupled within the flextensional mechanism; a ring-shaped shoulder formed around an interior circumference of the housing; a flange formed about an outer circumference of the shaft, the flange located within the housing; a spring disposed within the housing so as to bias the flange towards the shoulder; the plurality of modular actuator assemblies are dimensioned and arranged to be interchangeably disposed between the shoulder and the flange so as to axially oscillate the flange with respect to the shoulder against the spring as the shaft rotates with respect to the housing; the shaft carries a magnet; at least one of the plurality of modular actuator assemblies includes a winding in magnetic communication with the magnet to form an electrical generator; the plurality of modular actuator assemblies include one or more from a group consisting of a mechanical actuator assembly, a hydraulic actuator assembly, and a piezoelectric actuator assembly; the plurality of modular actuator assemblies include one or more from a group consisting of a low frequency actuator assembly, a mid frequency actuator assembly, and a high frequency actuator assembly; the mechanical actuator assembly includes a first sleeve arranged so as to be rotationally fixed with respect to the housing, a second sleeve arranged so as to be rotationally fixed with respect to the shaft, and a shaped interface between the first and second sleeves defining a plurality of longitudinal peaks intervaled by a plurality of longitudinal valleys; the hydraulic actuator assembly includes or at least partially defines a hydraulic cylinder and at least one valve for alternately fluidly coupling the hydraulic cylinder between an interior of the shaft and an exterior of the housing; the piezoelectric actuator assembly includes at least one at least one piezo element; replacing the first modular actuator assembly with a second modular actuator assembly; axially vibrating the shaft at a second frequency with respect to the housing by the second modular actuator assembly as the shaft rotates with respect to the housing; installing a mechanical modular actuator assembly between the housing and the shaft; rotatively fixing a first sleeve of the mechanical modular actuator assembly to the housing; rotatively fixing a second sleeve of the mechanical modular to the shaft; axially oscillating the second sleeve with respect to the first sleeve as the shaft rotates with respect to the housing; installing a hydraulic modular actuator assembly between the housing and the shaft; pressurizing a hydraulic cylinder of the hydraulic modular actuator assembly with drilling fluid from an interior of the shaft so as to axially displace a piston; displacing the shaft with respect to the housing by the piston; venting the pressurized hydraulic cylinder to an exterior of the housing; installing a piezoelectric modular actuator assembly between the housing and the shaft; selectively applying an electric field across a piezo element of the piezoelectric modular actuator assembly so as to expand the piezo element along a dimension; monitoring a parameter associated with drilling; upon a change in the monitored parameter, replacing the first modular actuator assembly with a second modular actuator assembly, and axially vibrating the shaft at a first frequency with respect to the housing by the second modular actuator assembly as the shaft rotates with respect to the housing; monitoring a parameter associated with drilling; and upon a change in the monitored parameter, axially vibrating the shaft at a first second with respect to the housing by the first modular actuator assembly as the shaft rotates with respect to the housing.

The Abstract of the disclosure is solely for providing the a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A downhole oscillation tool for axially vibrating a drill bit, comprising:

a tubular housing;

a ring-shaped shoulder formed around an interior circumference of said housing;

an opening defined in a bottom end of said housing;

a shaft partially disposed within said housing and extending beyond a bottom end of said housing, said shaft being rotatively and axially movable with respect to said housing;

a modular actuator assembly interchangeably carried within said housing and disposed to axially oscillate said shaft with respect to said housing as said shaft rotates with respect to said housing, the modular actuator assembly receivable into said housing through said opening to engage the ring-shaped shoulder;

a flange formed about an outer circumference of said shaft, said flange receivable into said housing through said opening such that the modular actuator assembly is carried between said shoulder and said flange and disposed to axially oscillate said flange with respect to said shoulder;

a spring receivable into said housing through said opening so as to bias said flange towards said shoulder; and an end cap removably coupled to said housing over said opening and retaining said spring, said flange and said modular actuator assembly in said housing.

2. The downhole oscillation tool of claim 1 wherein:

said modular actuator assembly includes an axial bore formed therethrough; and said shaft passes through said bore.

3. The downhole oscillation tool of claim 1 wherein:

at least a portion of said modular actuator assembly is rotationally fixed with respect to said housing by one of the group consisting of at least a hirth joint, a spline, a serration, and a keyed joint.

4. The downhole oscillation tool of claim 1 further comprising:

an electrical generator disposed within said housing and coupled so as to provide power to said modular actuator assembly.

5. The downhole oscillation tool of claim 4 wherein:

a winding of said electrical generator is disposed within said modular actuator assembly.

6. The downhole oscillation tool of claim 1 wherein:

said shaft carries at least one magnet; and said modular actuator assembly includes at least one coil rotatively fixed with respect to said housing and inductively coupled with said at least one magnet so as to generate an electrical potential by rotation of said shaft with respect to said housing.

7. The downhole oscillation tool of claim 1 wherein:

said modular actuator assembly is one from a group consisting of at least a mechanical actuator assembly, a hydraulic actuator assembly, and a piezoelectric actuator assembly.

8. The downhole oscillation tool of claim 7 wherein said mechanical actuator assembly comprises:

a first sleeve arranged so as to be rotationally fixed with respect to said housing and having a shaped end with a plurality of longitudinal peaks intervaled by a plurality of longitudinal valleys defining a smoothly undulating first profile;

a second sleeve arranged so as to be rotationally fixed with respect to said shaft and having a shaped end with a plurality of longitudinal peaks intervaled by a plurality of longitudinal valleys defining a smoothly undulating second profile, said shaped end of said second sleeve engaging said shaped end of said first sleeve.

9. The downhole oscillation tool of claim 8 wherein said mechanical actuator comprises:

one of the group consisting of at least a hirth joint, a spline, a serration, and a keyed joint rotationally fixing said second sleeve to said shaft.

10. The downhole oscillation tool of claim 7 wherein:

said shaft is hollow and defines an interior;

said hydraulic actuator assembly includes or at least partially defines a hydraulic cylinder operable to impose an axial force on said shaft with respect to said housing, a first flow path hydraulically coupled between said interior of said shaft and said hydraulic cylinder, and a second flow path hydraulically coupled between said hydraulic cylinder and an exterior of said housing.

11. The downhole oscillation tool of claim 10 wherein:

said hydraulic cylinder includes a piston formed about an outer circumference of said shaft and dynamically sealed against an inner wall of said housing.

12. The downhole oscillation tool of claim 10 further comprising:

said hydraulic cylinder includes a plurality of discreet hydraulic cylinders disposed about said shaft within said housing.

13. The downhole oscillation tool of claim 10 further comprising:

a valve operatively disposed in at least one of said first and second flow paths so as to control a pressure in said hydraulic cylinder.

14. The downhole oscillation tool of claim 7 wherein:

said piezoelectric actuator includes at least one ring-shaped expansion member with at least one piezo element.

15. The downhole oscillation tool of claim 14 wherein:

said at least one piezo element is ring-shaped and characterized by axial expansion under an applied electric field.

16. The downhole oscillation tool of claim 14 wherein:

said at least one ring-shaped expansion member includes a flextensional mechanism; and said at least one piezo element is operatively coupled within said flextensional mechanism.

17. A system for axially vibrating a downhole drill bit, comprising:

a tubular housing;

a ring-shaped shoulder formed around an interior circumference of said housing;

an opening defined in a bottom end of said housing;

a shaft partially disposed within said housing and extending beyond a bottom end of said housing, said shaft being rotatively and axially movable with respect to said housing; and a plurality of interchangeable modular actuator assemblies each interchangeably securable within said housing and when so secured, disposed to axially oscillate said shaft with respect to said housing as said shaft rotates with respect to said housing, each interchangeable modular actuator assembly individually receivable into said housing through said opening to engage the ring-shaped shoulder;

a flange formed about an outer circumference of said shaft, said flange receivable into said housing through said opening such that each interchangeable modular actuator assembly may be individually carried between said shoulder and said flange and disposed to axially oscillate said flange with respect to said shoulder;

a spring receivable into said housing through the opening so as to bias said flange towards said shoulder; and an end cap removably coupled to said housing over said opening and retaining said spring, said flange and a selected interchangeable modular actuator assembly in said housing.

18. The system of claim 17 wherein:

said shaft carries a magnet; and at least one of said plurality of modular actuator assemblies includes a winding in magnetic communication with said magnet to form an electrical generator.

19. The system of claim 17 wherein:

said plurality of modular actuator assemblies include one or more from a group consisting of a mechanical actuator assembly, a hydraulic actuator assembly, and a piezoelectric actuator assembly.

20. The system of claim 17 wherein:

said plurality of modular actuator assemblies include one or more from a group consisting of a low frequency actuator assembly, a mid frequency actuator assembly, and a high frequency actuator assembly.

21. The system tool of claim 19 wherein:

said mechanical actuator assembly includes a first sleeve arranged so as to be rotationally fixed with respect to said housing, a second sleeve arranged so as to be rotationally fixed with respect to said shaft, and a shaped interface between said first and second sleeves defining a plurality of longitudinal peaks intervaled by a plurality of longitudinal valleys.

22. The system tool of claim 19 wherein:

said hydraulic actuator assembly includes or at least partially defines a hydraulic cylinder and at least one valve for alternately fluidly coupling said hydraulic cylinder between an interior of said shaft and an exterior of said housing.

23. The system tool of claim 19 wherein:

said piezoelectric actuator assembly includes at least one at least one piezo element.

24. A method for axially vibrating a downhole drill bit, comprising:

installing an interchangeable first modular actuator assembly against a ring-shaped shoulder formed around an interior circumference of a housing through an opening defined a bottom end of said housing;

installing a shaft at least partially within said housing through said opening such that a flange formed about an outer circumference of said shaft is received into said housing through said opening such that said first modular actuator assembly is carried between said shoulder and said flange and disposed to axially oscillate said flange with respect to said shoulder;

installing a spring into said housing through said opening so as to bias said flange towards said shoulder installing an end cap removably to said housing over said opening thereby retaining said spring, said flange and said first modular actuator assembly in said housing;

connecting said drill bit to a distal end of said shaft;

imparting an axial force on said drill bit via said housing, said first modular actuator, and said shaft;

rotating said shaft with respect to said housing; and axially vibrating said shaft at a first frequency with respect to said housing by said first modular actuator assembly as said shaft rotates with respect to said housing.

25. The method of claim 24, further comprising:

replacing said first modular actuator assembly with a second modular actuator assembly by removing said end cap, removing said first modular actuator assembly through said opening, installing said second modular actuator through said opening and replacing said end cap to thereby retain said second modular actuator assembly in said housing; and axially vibrating said shaft at a second frequency with respect to said housing by said second modular actuator assembly as said shaft rotates with respect to said housing.

26. The method of claim 24, further comprising:

installing a mechanical modular actuator assembly between said housing and said shaft;

rotatively fixing a first sleeve of said mechanical modular actuator assembly to said housing;

rotatively fixing a second sleeve of said mechanical modular to said shaft; and axially oscillating said second sleeve with respect to said first sleeve as said shaft rotates with respect to said housing.

27. The method of claim 24, further comprising:

installing a hydraulic modular actuator assembly between said housing and said shaft;

pressurizing a hydraulic cylinder of said hydraulic modular actuator assembly with drilling fluid from an interior of said shaft so as to axially displace a piston;

displacing said shaft with respect to said housing by said piston; and then venting said pressurized hydraulic cylinder to an exterior of said housing.

28. The method of claim 24, further comprising:

installing a piezoelectric modular actuator assembly between said housing and said shaft; and selectively applying an electric field across a piezo element of said piezoelectric modular actuator assembly so as to expand said piezo element along a dimension.

29. The method of claim 24, further comprising:

monitoring a parameter associated with drilling; and upon a change in the monitored parameter, replacing said first modular actuator assembly with a second modular actuator assembly, and axially vibrating said shaft at a second frequency with respect to said housing by said second modular actuator assembly as said shaft rotates with respect to said housing.

30. The method of claim 24, further comprising:

monitoring a parameter associated with drilling; and upon a change in the monitored parameter, axially vibrating said shaft at a second with respect to said housing by said first modular actuator assembly as said shaft rotates with respect to said housing.

* * * * *